US005429918A

United States Patent [19]

Seto et al.

[11] Patent Number: 5,429,918

[45] Date of Patent: Jul. 4, 1995

[54] SILVER HALIDE COLOR PHOTOGRAPHIC MATERIAL

[75] Inventors: Nobuo Seto; Masakazu Morigaki, both of Kanagawa, Japan

[73] Assignee: Fuji Photo Film Co., Ltd., Minami-ashigara, Japan

[21] Appl. No.: 108,544

[22] Filed: Aug. 19, 1993

[30] Foreign Application Priority Data

Aug. 25, 1992 [JP] Japan ..... 4-226152

[51] Int. Cl.[6] ..... G03C 1/08; G03C 7/26; G03C 7/32

[52] U.S. Cl. ..... 430/551; 430/502; 430/503; 430/613; 430/372

[58] Field of Search ..... 430/551, 372, 613, 502, 430/503

[56] References Cited

U.S. PATENT DOCUMENTS 5,260,177 11/1993 Aoki et al. ..... 430/505

*Primary Examiner*—Charles L. Bowers, Jr.
*Assistant Examiner*—Geraldine Letscher
*Attorney, Agent, or Firm*—Burns, Doane, Swecker & Mathis

[57] ABSTRACT

A silver halide color photographic material contains at least one hydroxypyridine compound of formulae (A), (B) and (C) in at least one layer on the support:

(A)

(B)

(C)

The material is capable of providing a color image having an improved fastness to light.

15 Claims, No Drawings

SILVER HALIDE COLOR PHOTOGRAPHIC MATERIAL

FIELD OF THE INVENTION

The present invention relates to a silver halide color photographic material which is capable, upon development, of providing a color image having improved fading resistance and discoloration resistance.

BACKGROUND OF THE INVENTION

A silver halide color photographic material generally has silver halide emulsion layers each being sensitive to the three primary colors of red, green and blue. It is typically processed by a so-called subtractive color process of reproducing a color image where the three couplers in the respective emulsion layers yield colors which are complementary to the colors to which the respective layers are sensitive. The color image obtained by processing such a silver halide color photographic material is generally composed of an azomethine dye or indoaniline dye to be formed by reaction of an aromatic primary amine color developing agent and a coupler. The color photographic image thus obtained is not always stable to light or wet heat. When it is exposed to light for a long period of time or it is stored under the condition of high temperature and high humidity, the color image is often faded or discolored so that the quality of the thus exposed or stored image is deteriorated.

Such fading and discoloration of the color images formed are fatal drawbacks for recording materials. In order to remove these drawbacks, couplers capable of forming fast color images have been developed and anti-fading agents have been employed. For the purpose of preventing deterioration of the image quality due to ultraviolet rays, ultraviolet absorbents have been used.

Anti-fading agents have had a significant effect of preventing deterioration of color images formed. Examples of anti-fading agents, which have been added to color photographic materials include hydroquinones, hindered phenols, catechols, gallates, aminophenols, hindered amines, chromanols, indanes and ethers or esters of these compounds as formed by silylating, acylating or alkylating the phenolic hydroxyl group of them, as well as metal complexes.

Although these compounds can have an effect as an anti-fading or anti-discoloring agent for color images, they are still insufficient for meeting the customers' need of desiring to have color images with higher image quality. In addition, the compounds often vary the color hue of the color images formed or would often cause fogging of the photographic materials. Further, they can not be dispersed well in the coating emulsion, and/or after the emulsion containing them has been coated on a photographic support, they often form fine crystals. Because of the reasons, the compounds are not considered practical as additives to color photographic materials.

SUMMARY OF THE INVENTION

One object of the present invention is to provide a silver halide color photographic material capable of forming a color image which is neither faded nor discolored for a long period of time and which has excellent storability and storage stability.

Another object of the present invention is to provide a silver halide color photographic material containing photographic additives which do not change the hue of the color image formed. The additives in the material do not fog the material and can sufficiently prevent fading or discoloration of the color image formed. Additionally, after coating, they do not produce fine crystals on the material.

Still another object of the present invention is to provide a silver halide color photographic material containing photographic additives which are soluble in high boiling point organic solvents. Before and after coating, the additives do not form fine crystals. In addition, the additives do not adversely affect other photographic additives.

Still another object of the present invention is to provide a silver halide color photographic material containing photographic additives which effectively prevent the density of a color image formed by coloration of the couplers in the material from fading even after the color image has been stored for a long period of time while also preventing formation of color stains in the non-exposed white background areas of such materials.

The present inventors have determined that one or more objects of the present invention can be attained by incorporating at least one compound of the following general formulae (A) to (C) into a silver halide color photographic material.

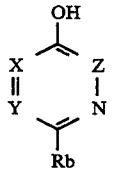

(A)

where one of X, Y and Z represents —N=, and the other two each represent —C(Ra)=, or X, Y and Z each represents —C(Ra)=; the plural Ra's may be same as or different from each other and each represents a hydrogen atom, a halogen atom, an aliphatic group, an aryl group, a heterocyclic group, an acylamino group, a sulfonamido group, a carbamoyl group, a sulfamoyl group, a carbamoylamino group, a sulfamoylamino group, an aliphatic, aryl or heterocyclicoxycarbonylamino group, an aliphatic, aryl or heterocyclic-oxycarbonyl group, an acyl group, a sulfonyl group, or an aliphatic, aryl or heterocyclic-oxy group;

Rb represents an aliphatic group, an aryl group, an acylamino group, an amino group or a hydroxyl group;

adjacent Ra's or Ra and Rb, if any, may be bonded to each other to form a 5-membered t0 7-membered ring;

when Ra in Y is bonded to Rb to form a 5-membered to 7-membered ring, Rb may also be an oxygen atom to form a 5-membered to 7-membered ring; and the formula may form a dimer or a higher polymer at Ra and/or Rb.

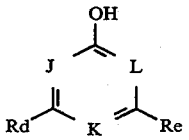

(B)

where one or two of J, K and L represent —N=, and the other(s) represents or each represent —C(Rc)=;

each Rc may be same as or different from another and represents a hydrogen atom, a hydroxyl group, an aliphatic group, an aryl group, a heterocyclic group, an acylamino group, a sulfonamido group, a carbamoyl group, a sulfamoyl group, a carbamoylamino group, a sulfamoylamino group, an aliphatic, aryl or heterocyclic-oxycarbonylamino group, an aliphatic, aryl or heterocyclic-oxycarbonyl group, an acyl group, a sulfonyl group, or an aliphatic, aryl or heterocyclic-oxy group;

Rd and Re each represent an aliphatic group, an aryl group, an acylamino group, or an amino group;

the adjacent Rc and Rd or Re, if any, may be bonded to each other to form a 5-membered or 7-membered ring, and, as the case may be, Rd or Re may also be an oxygen at m to form a 5-membered to 7-membered ring; and the formula may form a dimer or a higher polymer at Rc, Rd and/or Re.

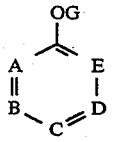

(C)

where one or two of A, B, C, D and E represent —N=, and the others each represent —C(RF)=;

each Rf may be same as or different from one another and represent a hydrogen atom, a halogen atom, an aliphatic group, an aryl group, a heterocyclic group, an acylamino group, a sulfonamido group, a carbamoyl group, a sulfamoyl group, a carbamoylamino group, a sulfamoylamino group, an aliphatic, aryl or heterocyclic-oxycarbonylamino group, an aliphatic, aryl or heterocyclic-oxycarbonyl group, an acyl group, a sulfonyl group, an aliphatic, aryl or heterocyclic-oxy group, an aliphatic, aryl or heterocyclic-thio group, an acyloxy group, a sulfonyloxy group, or an amino group, provided that all Rf's must not be hydrogen atoms at the same time;

G represents an aliphatic group, an aryl group, a heterocyclic group, an acyl group, or a sulfonyl group; the adjacent Rf's, if any, may be bonded to each other to form a 5-membered to 7-membered ring; and the formula may form a dimer or higher polymer at Rf and/or G.

DETAILED DESCRIPTION OF THE INVENTION

The aliphatic moiety as referred to herein may be linear, branched or cyclic and may be saturated or unsaturated. For example, it can be an alkyl moiety, an alkenyl moiety, an alkynyl moiety, a cycloalkyl moiety or a cycloalkenyl moiety. The moiety may also have substituent(s). The aliphatic moiety is preferably an alkyl or cycloalkyl moiety, The aryl moiety as referred to herein is a hydrocarbon aromatic moiety and it is preferably a phenyl moiety. The aryl moiety may also have substituent(s). The heterocyclic moiety as referred to herein is one having at least one hetero atom (preferably, nitrogen atom, oxygen atom, sulfur atom) in the ring(s) of constituting the moiety, and the ring(s) may be saturated ring(s) or aromatic ring(s). For instance, mentioned are pyridine ring, morpholine ring, piperazine ring and oxazoline ring. These may further have substituent(s).

The substituent as referred to herein may be any and every substitutable group, including, for example, an aliphatic group, an aryl group, a heterocyclic group, an acyl group, an acyloxy group, an acylamino group, an aliphatic, aryl or heterocyclic-oxy group, an aliphatic, aryl or heterocyclic-oxycarbonyl group, a carbamoyl group, a sulfonyl group, a sulfonyloxy group, a sulfamoyl group, a sulfonamido group, an amino group, a sulfinyl group, an aliphatic or aryl-thio group, a mercapto group, a hydroxyl group, a cyano group, a nitro group, a hydroxyamino group, a carbamoylamino group, a sulfamoylamino group and a halogen atom.

Compounds of formulae (A) to (C) will be explained in more detail hereunder.

The aliphatic group in these formulae is preferably an alkyl group having from 1 to 40 carbon atoms, more preferably from 1 to 28 carbon atoms, which may optionally have substituent(s); or an alkenyl group having from 2 to 40 carbon atoms, which may optionally have substituent(s). Suitable examples include methyl, ethyl, isopropyl, t-butyl, cyclohexyl, 2-ethylhexyl, hexadecyl, dodecyl, vinyl, benzyl, 2-hydroxybenzyl, 1,1-dimethyl-4-methoxycarbonylbutyl and allyl groups.

The aryl group preferably has from 6 to 46 carbon atoms and may optionally have substituent(s). Suitable examples include phenyl, 2-hydroxyphenyl and 4-hydroxyphenyl groups.

The heterocyclic group is preferably a 5-membered to 7-membered ring having from 3 to 43 carbon atoms and optionally having substituent(s). Suitable examples include pyridyl, morpholinyl, tetrahydropyranyl and piperazinyl groups.

The acylamino group is preferably an optionally substituted alkylacylamino group having from 2 to 42 carbon atoms, or an optionally substituted arylacylamino group having from 7 to 47 carbon atoms. Suitable examples include acetylamino, 2,4-di-tert-amylphenoxyacetylamino, benzoylamino and 4-tert-octylphenoxyacetylamino groups.

The sulfonamido group is preferably an optionally substituted alkylsulfonamido group having from 1 to 40 carbon atoms, or an optionally substituted arylsulfonamido group having from 6 to 46 carbon atoms. Suitable examples include methanesulfonamido, hexadecanesulfonamido, p-toluenesulfonamido and 4-dodecyloxybenzenesulfonamido groups.

The carbamoyl group in them is preferably an optionally substituted alkylcarbamoyl group having from 2 to 42 carbon atoms, or an optionally substituted arylcarbamoyl group having from 7 to 47 carbon atoms. Suitable examples include, for example, dibutylcarbamoyl, dodecylcarbamoyl, 4-dodecyloxyphenylcarbamoyl and N-methyl-N-phenylcarbamoyl groups.

The sulfamoyl group is preferably an optionally substituted alkylsulfamoyl group having from 1 to 40 carbon atoms, or an optionally substituted arylsulfamoyl group having from 6 to 46 carbon atoms; and can comprise, for example, dimethylsulfamoyl, octadecylsulfamoyl, phenylsulfamoyl and N-ethyl-N-phenylsulfamoyl groups.

The acyl group is preferably an optionally substituted alkylacyl group having from 2 to 42 carbon atoms, or an optionally substituted arylacyl group having from 7 to 47 carbon atoms; and can comprise, for example, acetyl, myristoyl, 2,4-di-tert-amylphenoxyacetyl, benzoyl and 4-acetylbenzoyl groups.

The carbamoylamino group is preferably an unsubstituted carbamoylamino group, an optionally substituted alkylcarbamoylamino group having from 2 to 42 carbon atom, or an optionally substituted arylcarbamoylamino group having from 7 to 47 carbon atoms; and can comprise, for example, dimethylcarbamoylamino, phenylcarbamoylamino and N-ethyl-N-phenylcarbamoylamino groups.

The sulfamoylamino group is preferably an unsubstituted sulfamoylamino group, an optionally substituted alkylsulfamoylamino group having from 1 to 40 carbon atoms, or an optionally substituted arylsulfamoylamino group having from 6 to 46 carbon atoms; and can comprise, for example, dibutylsulfamoylamino and 4-methoxyphenylsulfamoylamino groups.

The aliphatic, aryl or heterocyclic-oxycarbonyl group is preferably an optionally substituted alkoxycarbonyl group having from 2 to 42 carbon atoms, or an optionally substituted aryloxycarbonyl group having from 7 to 47 carbon atoms; and can comprise, for example, methoxycarbonyl, hexadecyloxycarbonyl, benzyloxycarbonyl, phenoxycarbonyl and 4-tert-phenoxycarbonyl groups.

The aliphatic, aryl or heterocyclicoxycarbonylamino group is preferably an optionally substituted alkoxycarbonylamino group having from 2 to 42 carbon atoms, or an optionally substituted aryloxycarbonylamino group having from 7 to 47 carbon atoms; and can comprise, for example, methoxycarbonylamino, octyloxycarbonylamino, phenoxycarbonylamino and 4-octyloxyphenoxycarbonylamino groups.

The aliphatic, aryl or heterocyclic-thio group is preferably an optionally substituted alkylthio group having from 1 to 40 carbon atoms, or an optionally substituted arylthio group having from 6 to 46 carbon atoms; and can comprise, for example, butylthio, hexadecylthio, tert-butylthio, phenylthio and 4-tert-butylphenylthio groups.

The sulfonyl group preferably an optionally substituted alkanesulfonyl group having from 1 to 40 carbon atoms, or an optionally substituted arylsulfonyl group having from 6 to 46 carbon atoms; and can comprise, for example, methanesulfonyl, octanesulfonyl, benzenesulfonyl, 4-methylbenzenesulfonyl and 4-dodecyloxybenzenesulfonyl groups.

The amino group is preferably an optionally substituted alkylamino group having from 1 to 40 carbon atom, or an optionally substituted arylamino group having from 6 to 46 carbon atoms; and can comprise, for example, di-tert-butylamino, di-2-ethylhexylamino and N-octylanilino groups.

The aliphatic, aryl or heterocyclic-oxy group is preferably an optionally substituted alkoxy group having from 1 to 40 carbon atoms, or an optionally substituted aryloxy group having from 6 to 46 carbon atoms; and can comprise, for example, methoxy, hexadecyloxyethoxy, phenoxy and 4-methanesulfonylphenoxy groups.

The acyloxy group is preferably an optionally substituted alkylacyloxy group having from 2 to 42 carbon atoms, or an optionally substituted arylacyloxy group having from 7 to 47 carbon atoms; and can comprise, for example, acetyloxy, pivaloyloxy and benzoyloxy groups.

The sulfonyloxy group in them is preferably an optionally substituted alkanesulfonyloxy group having from 1 to 40 carbon atoms, or an optionally substituted arylsulfonyloxy group having from 6 to 46 carbon atoms; and can comprise, for example, methanesulfonyloxy, butanesulfonyloxy and benzenesulfonyloxy groups.

The halogen atom can comprise, for example, chlorine atom and bromine atom.

Preferred compounds according to formula (A) are those compounds where X, Y and Z each represents —C(Ra)=. Also, Ra is preferably a hydrogen atom, an alkyl group, an aryl group, a heterocyclic group, an acylamino group, an alkyl or aryloxycarbonylamino group, a carbamoylamino group, an alkoxycarbonyl group or a carbamoyl group and at least one of Ra's is more preferably an acylamino group, an alkyl or aryloxycarbonylamino group, or a carbamoylamino group, and most preferably an acylamino group.

Rb is preferably an alkyl group or an acylamino group and is most preferably an alkyl group. Also, Ra in Z is preferably not a hydrogen atom.

Preferred compounds according to formula (B) are those compounds where one of J, K and L is —N=. Also, Rc is preferably a hydrogen atom, an alkyl group, an aryl group, a heterocyclic group, an acylamino group, an alkyl or aryloxycarbonylamino group, a carbamoylamino group, an alkoxycarbonyl group or a carbamoyl group and at least one of Rc's is more preferably an acylamino group, an alkyl or aryloxycarbonylamino group, or carbamoylamino group, and most preferably an acylamino group. Rd and Re each are preferably a hydrogen atom, an aliphatic group or an acylamino group and are most preferably a hydrogen atom or an aliphatic group.

Preferred compounds according to formula (C) include those compounds where A and B, or A and D, or B and C, or B and D, or only A, or only B are/is —N=, and the others are —C(RF)=; and more preferred are compounds of formula (C) where B and D, or only B are/is —N=, and the others are —C(Rf)=. Also, Rf is preferably a hydrogen atom, an alkyl group, an aryl group, a heterocyclic group, an acylamino group, an alkyl or aryloxycarbonylamino group, a carbamoylamino group, an alkoxycarbonyl group, a carbamoyl group, an alkyl or aryloxy group, an alkyl or arylthio group, or a halogen atom. G is preferably an alkyl group, an alkenyl group, a heterocyclic group or an acyl group, more preferably an alkyl group, an alkenyl group, or an acyl group and most preferably an alkyl group.

Compounds of formulae (A) to (C) are preferably those each having, as a whole, from 10 to 60 carbon atoms, more preferably from 18 to 60 carbon atoms.

In view of the effect of the present invention, compounds of formulae (A) and (C) are preferred and compounds of formula (A) are more preferred.

The compounds of formulae (A) to (C) of the present invention can prevent fading of the dyes to be formed from couplers, but are not themselve couplers. Therefore, the groups of the compounds do not split off therefrom by coupling reaction with an oxidation product of a developing agent.

Specific examples of compounds of formulae (A) to (C) for use in the present invention are mentioned below, which, however, are not limitative.
(A-1)
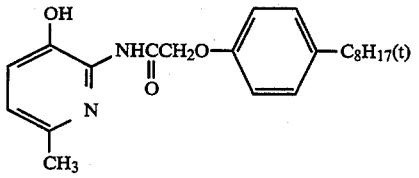
(A-2)
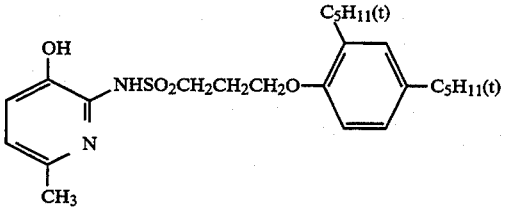
(A-3)
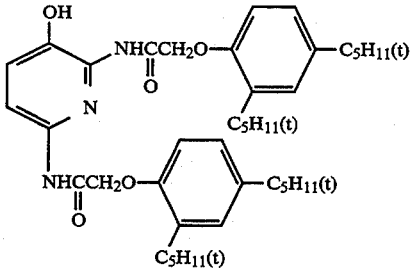
(A-4)
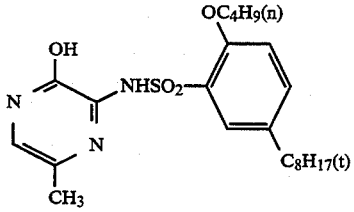
(A-5)
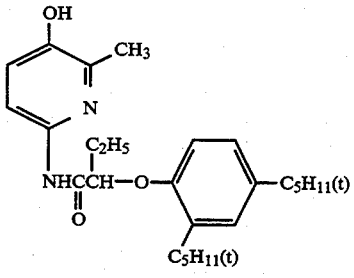
(A-6)
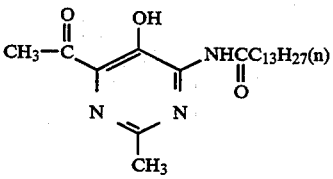
(A-7)
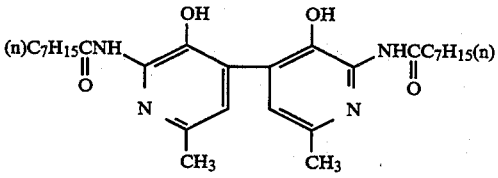
-continued
(A-8)
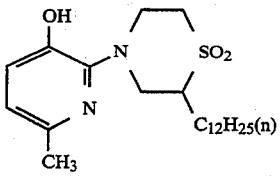
(A-9)
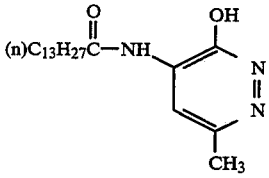
(A-10)
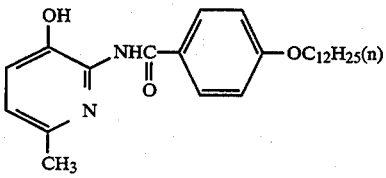
(A-11)
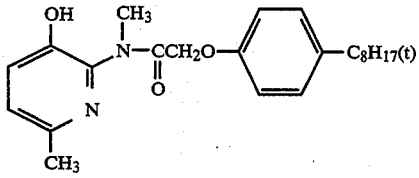
(A-12)
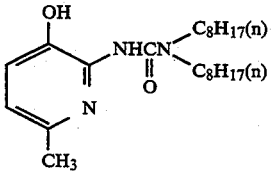
(A-13)
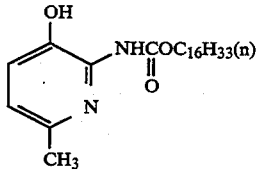
(A-14)
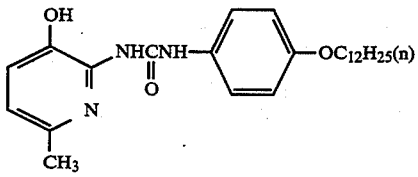
(A-15)
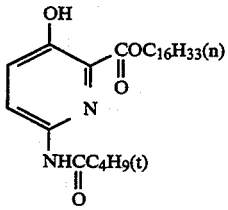

-continued
(A-16)
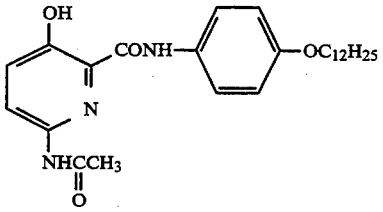
(A-17)
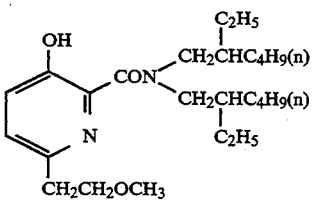
(A-18)
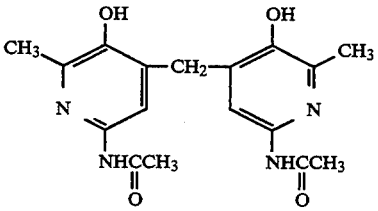
(A-19)
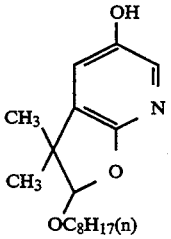
(A-20)
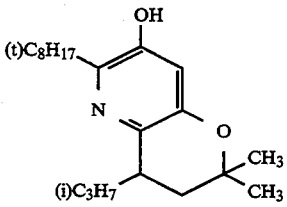
(A-21)
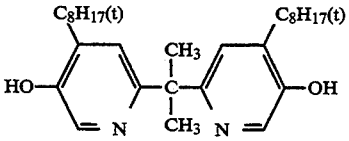
(A-22)
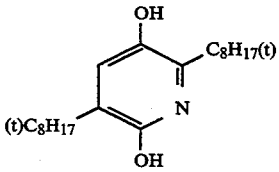
(A-23)
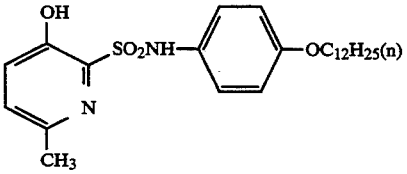
-continued
(A-24)
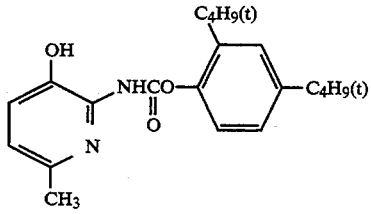
(A-25)
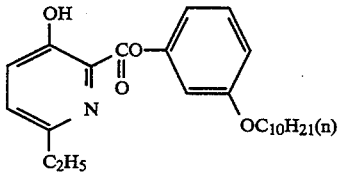
(A-26)
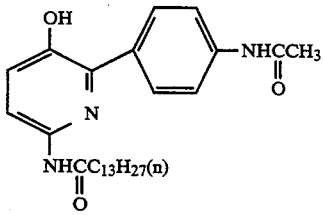
(A-27)
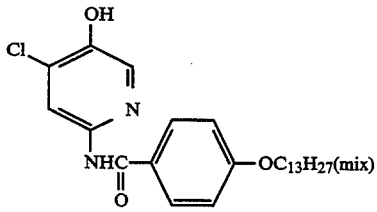
(A-28)
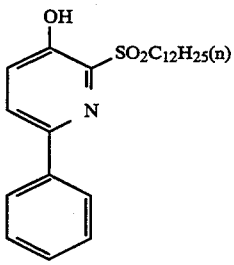
(A-29)
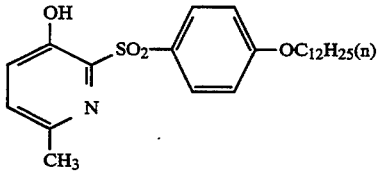
(A-30)
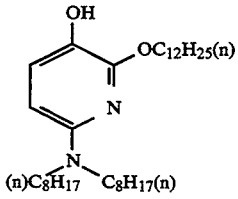

-continued
(A-31)
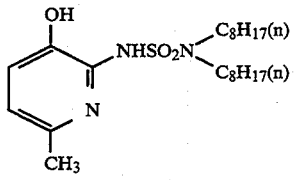
(A-32)
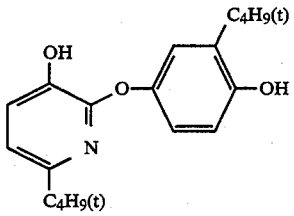
(B-1)
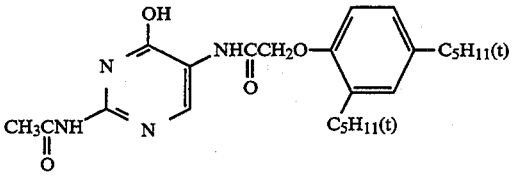
(B-2)
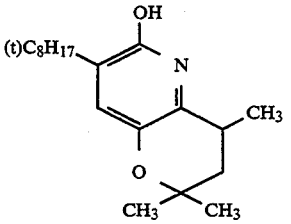
(B-3)
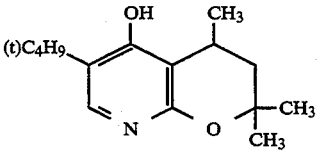
(B-4)
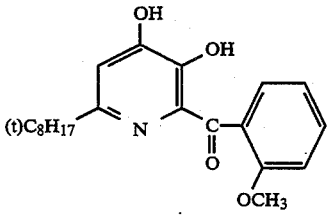
(B-5)
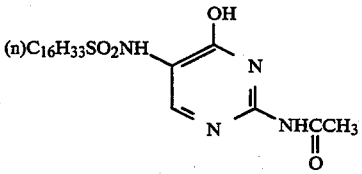
(B-6)
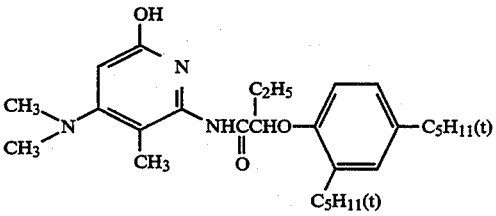
-continued
(B-7)
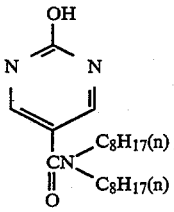
(B-8)
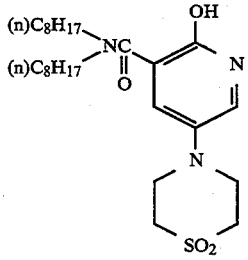
(B-9)
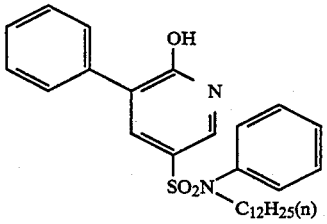
(B-10)
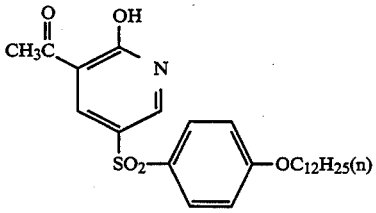
(B-11)
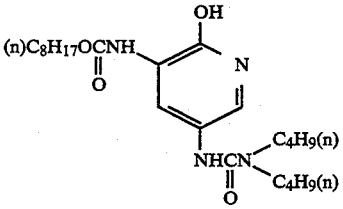
(B-12)
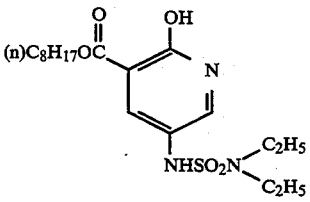
(B-13)
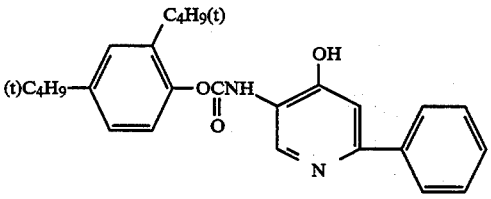

-continued
(C-1)
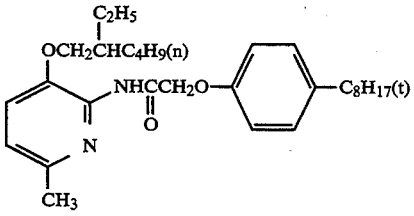
(C-2)
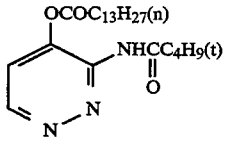
(C-3)
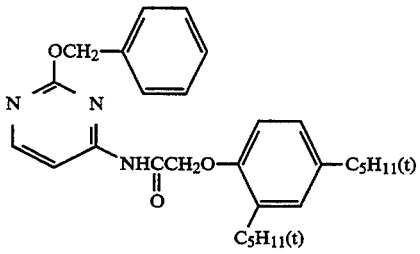
(C-4)
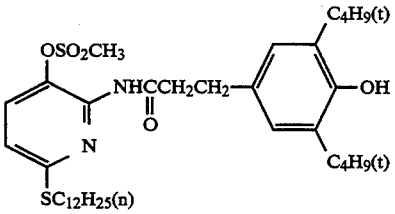
(C-5)
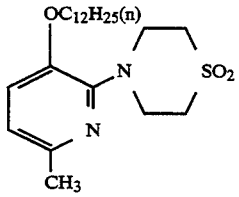
(C-6)
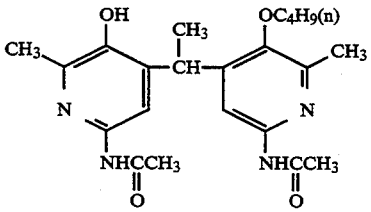
(C-7)
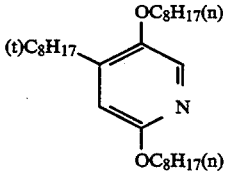
(C-8)
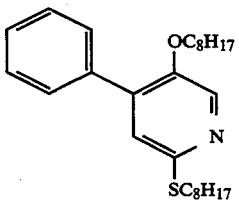
-continued
(C-9)
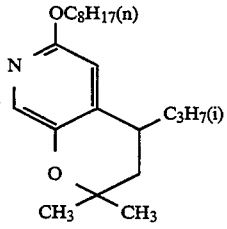
(C-10)
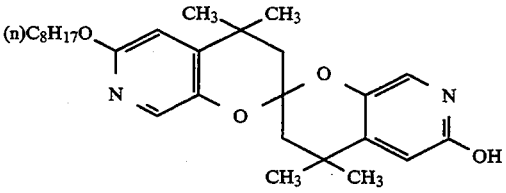
(C-11)
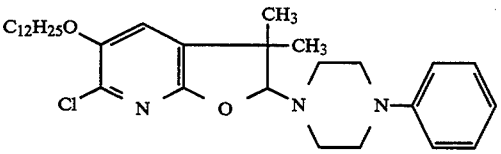
(C-12)
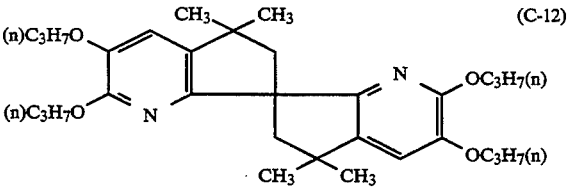
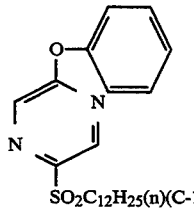
$SO_2C_{12}H_{25}(n)$(C-13)
(C-14)
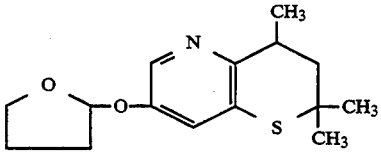
(C-15)
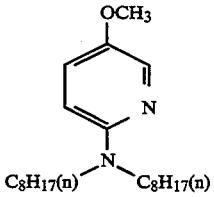
(C-16)
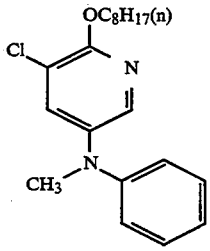

-continued (C-17)

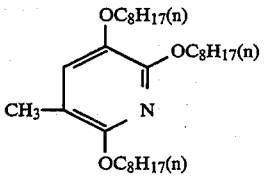

(C-18)

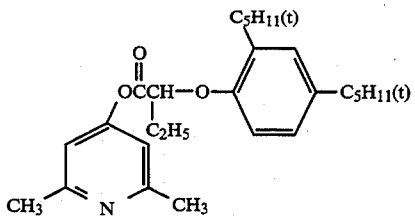

(C-19)

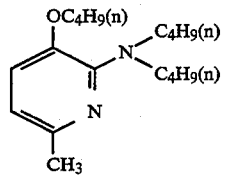

(C-20)

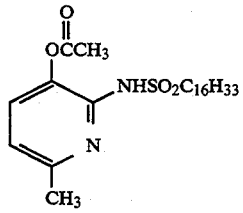

(C-21)

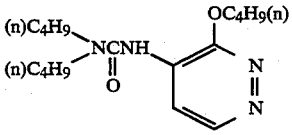

(C-22)

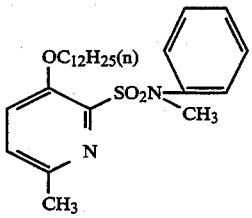

(C-23)

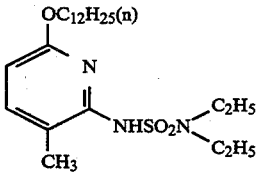

(C-24)

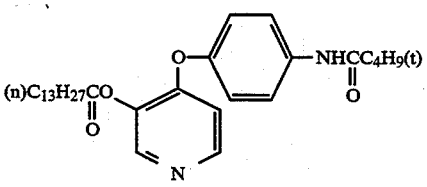

-continued (C-25)

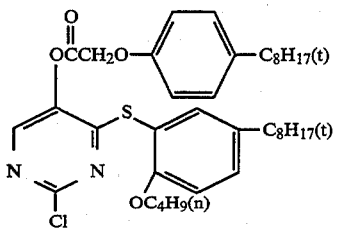

(C-26)

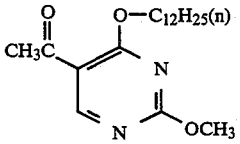

(C-27)

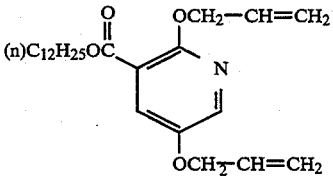

(C-28)

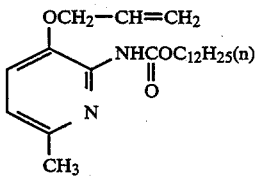

(C-29)

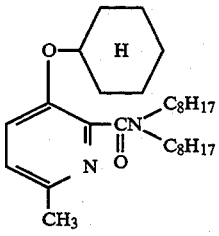

(C-30)

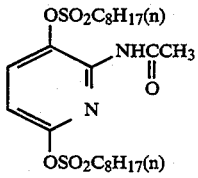

(C-31)

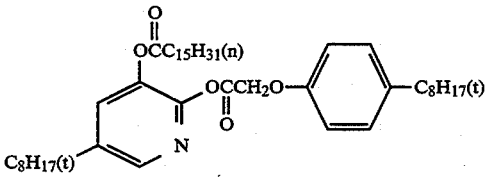

Methods of producing compounds of formulae (A) to (C) for use in the present invention are mentioned below. Compounds of formulae (A) to (C) may be produced, in general, by conventional hydroxylation, amidation and esterification of the corresponding nitrogen-containing heterocyclic compounds. Suitable examples demonstrating production of typical compounds of them are mentioned below solely for illustration. Production of Compound (A-1):

Compound (A-I) was produced in accordance with the reaction route illustrated below.

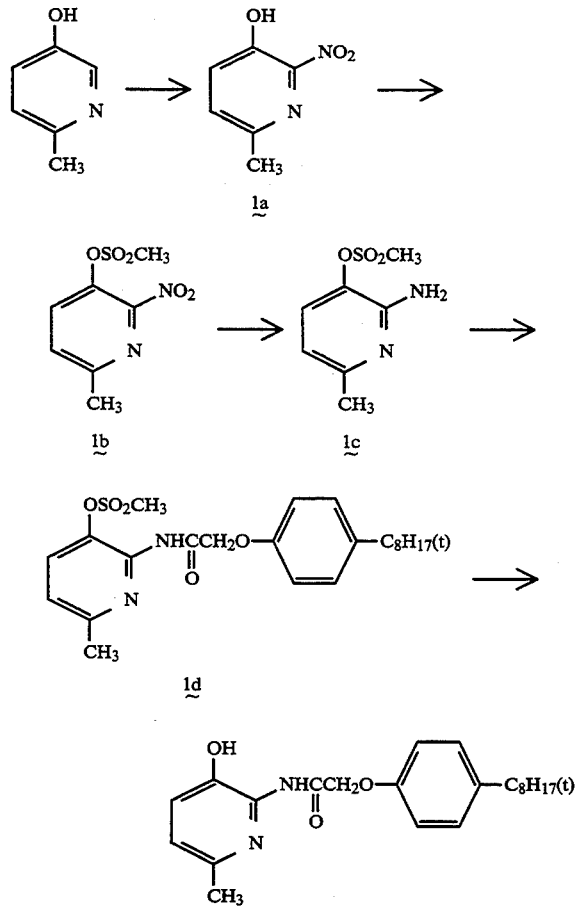

30 ml of concentrated sulfuric acid was gradually added to 10 g of 3-hydroxy-6-methylpyridine and dissolved it. 7.5 ml of concentrated nitric acid (having a specific gravity of 1.38) was dropwise added thereto over a period of 15 minutes, with stirring it at an internal temperature of from 40° to 50° C. This mixture was stirred for one hour at 50° C. 45 g of sodium hydroxide was dissolved in 250 cc of ice water, and the previous reaction solution was gradually added thereto with stirring. 10 m of acetic acid was added thereto. The reaction solution was then extracted two times each with 100 ml of ether. The ether layer was washed two times each with 100 ml of saturated saline solution and then dried with magnesium sulfate. The magnesium sulfate was taken out by filtration, and the ether was removed by distillation under reduced pressure. The product was purified by silica gel column chromatography and then crystallized with 15 ml of acetonitrile to obtain white crystals. The crystals were identified to be the intermediate la, from their IR spectrum, NMR spectrum and MS spectrum. The yield of the intermediate la was 6.8 g (48.1%), and it had a melting point of from 106° to 107° C.

40 ml of acetonitrile and 6.8 ml of triethylamine were added to 6.8 g of the intermediate la and dissolved it. 3.5 ml of methanesulfonyl chloride was dropwise added to the solution over a period of 5 minutes, with stirring it at an internal temperature of from 20° to 25° C. The reaction solution was poured into 100 ml of ice water and then extracted with 100 ml of ethyl acetate. The ethyl acetate layer was washed two times each with 50 ml of saturated saline solution and dried with magnesium sulfate. The magnesium sulfate was taken out by filtration and the ethyl acetate was removed by distillation under reduced pressure.

100 ml of ethanol and 0.5 g of 10% palladium/carbon were added to the residue, and this was then stirred in a 200 ml-autoclave at 50° C., to which hydrogen gas (53 kg/cm$^2$) was added. The reaction system was returned back to normal pressure and room temperature, and the reaction solution was filtered and the ethanol was removed by distillation under reduced pressure. The product was crystallized with 15 ml of methanol to obtain white crystals. The crystals were identified to be the intermediate 1c, from their IR spectrum, NMR spectrum and MS spectrum. The yield of the intermediate 1c was 7.3 g (81.6%), and it had a melting point of from 130° to 133° C.

20 ml of acetonitrile and 20 ml of dimethylacetamide were added to 3.5 g of the intermediate 1c and dissolved it. 5.1 g of 4-t-octylphenoxyacetyl chloride was dropwise added thereto over a period of 10 minutes, while stirring it at an internal temperature of from 20° to 25° C. The reaction solution was poured into 100 ml of ice water and then extracted with 100 ml of ethyl acetate. The ethyl acetate layer was washed two times each with 100 ml of saturated saline solution, and the ethyl acetate was removed by distillation under reduced pressure. 50 ml of 10% potassium hydroxide/methanol solution was added to the residue in a nitrogen stream and stirred for 30 minutes at 23° to 25° C. The reaction solution was poured into 100 ml of ice water containing 5 ml of acetic acid and then extracted with 100 ml of ethyl acetate. The ethyl acetate layer was washed two times each with 100 ml of saturated saline solution and then dried with magnesium sulfate. The magnesium sulfate was removed by filtration and the ethyl acetate was removed by distillation under reduced pressure. The product was purified by silica gel chromatography and then crystallized with 20 ml of n-hexane to obtain white crystals. The crystals were identified to be Compound (A-1) from their IR spectrum, NMR spectrum and MS spectrum. The yield of the product was 4.9 g (76.3%), and it had a melting point of from 126° to 127° C. Production of Compound (C-1):

15 ml of dimethylformamide was added to 5 g of Compound (A-1), and 3.7 g of potassium carbonate was added thereto. 2.8 g of 2-ethylhexyl bromide was dropwise added thereto while stirring it at an internal temperature of from 80° to 90° C., and the whole was stirred for further 3 hours at 85° to 90° C. The reaction solution was poured into ice water and then extracted with 100 ml of ethyl acetate. The ethyl acetate layer was washed two times each with 100 ml of saturated saline solution and then dried with anhydrous magnesium sulfate. The magnesium sulfate was removed by filtration and the ethyl acetate was removed by distillation under reduced pressure. The product was purified by silica gel column chromatography to obtain a colorless viscous liquid. The liquid was identified to be Compound (C-1) from its IR spectrum, NMR spectrum and MS spectrum. The yield of the product was 5.2 g (79.7%).

Compounds of formulae (A) to (C) may be added to at least one layer on the support. In view of the effect of the present invention, it is desired that they be added to the light-sensitive silver halide emulsion layer. More preferably, they are added as a coemulsion with a dye-forming coupler to the layer.

Compounds of formulae (A) to (C) can be used along with any known anti-fading agent. In this case, the anti-fading effect is increased. Two or more of compounds of formulae (A) to (C) may also be used together.

Compounds of formulae (A) to (C) may be added to the layer(s) containing yellow couplers, magenta couplers or cyan couplers. They are preferably added to the layer(s) containing yellow couplers or azole magenta couplers or cyan couplers. Where they are added to the layer(s) containing azole couplers, it is further preferred that such layer(s) additionally contain compounds of formulae (A-I) to (A-XIII) of EP 0544316 as the anti-fading effect of the added compounds can be greatly increased. In particular, the combination can be greatly preferred when the color density of the formed image is low. The effect is especially significant when compounds of formula (A) or (B) of the present invention are employed. The amount of the compounds to be added in combination of them is preferably from 1 to 300 mol % more preferably from 5 to 200 mol %, to the couplers to be in the layer.

The amount of the compounds of formulae (A) to (C) for use in the present invention is, though varying in accordance with the kind of the couplers to be used together (preferably in one and the same layer), suitably from 0 5 to 300 mol % preferably from 1 to 200 mol %, of the couplers employed.

The compounds of formulae (A) to (C) of the present invention can be incorporated into photographic materials by various known dispersion methods. Preferably, they are dissolved in a high boiling point organic solvent (optionally along with a low boiling point organic solvent) and emulsified and dispersed in an aqueous gelatin solution and the resulting dispersion is added to a silver halide emulsion, in accordance with an oil-in-water dispersion method.

Examples of high boiling point solvents to be used in an oil-in-water dispersion method which may be employed in the present invention are described in U.S. Pat. No. 2,322,027. As one example of a polymer dispersion method, a "latex dispersion" method may be employed. The process of such a latex dispersion method, effects of the same and specific examples of latexes for impregnation which are used in such a method, are described in U.S. Pat. No. 4,199,363, German Patent OLS Nos. 2,541,274 and 2,541,230, JP-B-53-41091 and European Patent Application Laid-Open No. 029104. A dispersion method of using organic solvent-soluble polymers which is described in PCT Laid-Open WO88/00723 may also be employed.

Suitable examples of high boiling point organic solvents usable in the above-mentioned oil-in-water method, include phthalic acid esters (e.g., dibutyl phthalate, dioctyl phthalate, dicyclohexyl phthalate, di-2-ethylhexyl phthalate, decyl phthalate, bis(2,4-di-t-amylphenyl)isophthalate, bis(1,1-diehtylpropyl)phthalate), phosphoric acid or phosphonic acid esters (e.g., diphenyl phosphate, triphenyl phosphate, tricresyl phosphate, 2-ethylhexyl-diphenyl phosphate, dioctylbutyl phosphate, tricyclohexyl phosphate, tri-2-ethylhexyl phosphate, tridodecyl phosphate, di-2-ethylhexylphenyl phosphonate), benzoic acid esters (e.g., 2-ethylhexyl benzoate, 2,4-dichlorobenzoate, dodecyl benzoate, 2-ethylhexyl p-hydroxybenzoate), amides (e.g., N,N-diethyldodecanamide, N,N-diethyllaurylamide), alcohols or phenols (e.g., isostearyl alcohol, 2,4-di-tert-amylphenol), aliphatic esters (e.g., dibutoxyethyl succinate, di-2-ethylhexyl succinate, 2-hexyldecyl tetradecanoate, tributyl citrate, trioctyl tosylate), aniline derivatives (e.g., N,N-dibutyl-2-butoxy-5-tert-octylaniline), chlorinated paraffins (e.g., paraffins having chlorine content of from 10% to 80%), trimesic acid esters (e.g., tributyl trimesate), dodecylbenzene, diisopropylnaphthalene, phenols (e.g., 2,4-di-tert-amylphenol 4-dodecyloxyphenol, 4dodecyloxycarbonylphenol, 4-(4-dodecyloxyphenylsulfonyl)phenol), carboxylic acids (e.g., 2-(2,4-di-tert-amylphenoxybutyric acid, 2-ethoxyoctanedecanoic acid), and alkylphosphoric acids (e.g., di-2-(ethylhexyl)-phosphoric acid, diphenylphosphoric acid). Suitable examples of auxiliary solvents usable along with the high boiling point organic solvents, include, for example, organic solvents having a boiling point of approximately from 30° C. to 160° C., such as ethyl acetate, butyl acetate, ethyl propionate, methyl ethyl ketone, cyclohexanone, 2-ethoxyethyl acetate, and dimethylformamide.

The weight ratio of the high boiling point organic solvent to the coupler may be from 0 to 5.0, preferably from 0 to 1.0.

For silver halide emulsions and other elements (additives, etc.) of constituting the photographic materials of the present invention as well as constitution of photographic layers (arrangement of layers, etc.) of the materials, and processing methods and processing additives to be used for processing the materials, for example, disclosures of the following references, especially the following European Patent EP 0,355,660A2, are hereby incorporated by reference.

| Photographic Elements | JP-A 62-215272 | JP-A 2-33144 | EP 0,355,660A2 |
|---|---|---|---|
| Silver Halide Emulsions | From page 10, right upper column, line 6 to page 12, left lower column, line 5; and from page 12, right lower column, line 4 to page 13, left upper column, line 17 | From page 28, right upper column, line 16 to page 29, right lower column, line 11; and page 30, lines 2 to 5 | From page 45, line 53 to page 47, line 3; and page 47, lines 20 to 22 |
| Silver Halide Solvents | Page 12, left lower column, lines 6 to 14; and from page 13, left upper column, line 3 from below to page 18, left lower column, last line | — | — |
| Chemical Sensitizers | Page 12, from left lower column, line 3 from below to right lower column, line 5 from below; and from page 18, right lower column, line 1 to page 22, right upper | Page 29, right lower column, line 12 to last line | Page 47, lines 4 to 9 |

-continued

| Photographic Elements | JP-A 62-215272 | JP-A 2-33144 | EP 0,355,660A2 |
|---|---|---|---|
| | column, line 9 from below | | |
| Color Sensitizers (Color Sensitizing Methods) | From page 22, right upper column, line 8 from below to page 38, last line | Page 30, left upper column, lines 1 to 13 | Page 47, lines 10 to 15 |
| Emulsion Stabilizers | From page 39, left upper column, line 1 to page 72, right upper column, last line | Page 30, from left upper column, line 14 to right upper column, line 1 | Page 47, lines 16 to 19 |
| Development Promoters | From page 72, left lower column, line 1 to page 91, right upper column, line 3 | — | — |
| Color Couplers (Cyan, Magenta and Yellow Couplers) | From page 91, right upper column, line 4 to page 121, left upper column, line 6 | From page 3, right upper column, line 14 to page 18, left upper column, last line; and from page 30, right upper column, line 6 to page 35, right lower column, line 11 | Page 4, lines 15 to 27; from page 5, line 30 to page 8, last line; page 45, lines 29 to 31; and from page 47, line 23 to page 63, line 50 |
| Coloring Enhancers | From page 121, left upper column, line 7 to page 125, right upper column, line 1 | — | — |
| Ultraviolet Absorbents | From page 125, right upper column, line 2 to page 127, left lower column, last line | From page 37, right lower column, line 14 to page 38, left upper column, line 11 | Page 65, lines 22 to 31 |
| Anti-fading Agents (Color Image Stabilizers) | From page 127, right lower column, line 1 to page 137, left lower column, line 8 | From page 36, right upper column, line 12 to page 37, left upper column, line 19 | From page 4, line 30 to page 5, line 23; from page 29, line 1 to page 45, line 25; page 45, lines 33 to 40; and page 65, lines 2 to 21 |
| High Boiling Point and/or Low Boiling Point Organic Solvents | From page 137, left lower column, line 9 to page 144, right upper column, last line | From page 35, right lower column, line 14 to page 36, left upper column, line 4 from below | Page 64, lines 1 to 51 |
| Dispersing Methods of Photographic Additives | From page 144, left lower column, line 1 to page 146, right upper column, line 7 | From page 27, right lower column, line 10 to page 28, left upper column, last line; and from page 35, right lower column, line 12, to page 36, right upper column, line 7 | From page 63, line 51 to page 64, line 56 |
| Hardening Agents | From page 146, right upper column, line 8 to page 155, left lower column, line 4 | — | — |
| Developing Agent Precursors | Page 155, from left lower column, line 5 to right lower column, line 2 | — | — |
| Development Inhibitor Releasing Compounds | Page 155, right lower column, lines 3 to 9 | — | — |
| Supports | From page 155, right lower column, line 19 to page 156, left upper column, line 14 | From page 38, right upper column, line 18 to page 39, left upper column, line 3 | From page 66, line 29 to page 67, line 13 |
| Constitution of Photographic Layers | Page 156, from left upper column, line 15 to right lower column, line 14 | Page 28, right upper column, lines 1 to 15 | Page 45, lines 41 to 52 |
| Dyes | From page 156, right lower column, line 15 to page 184, right lower column, last line | Page 38, from left upper column, line 12 to right upper column, line 7 | Page 66, lines 18 to 22 |
| Color Mixing Preventing Agents | From page 185, left upper column, line 1 to page 188, right lower column, line 3 | Page 36, right lower column, lines 8 to 11 | From page 64, line 57 to page 65, line 1 |
| Gradation Adjusting Agents | Page 188, right lower column, lines 4 to 8 | — | — |
| Stain Inhibitors | From page 188, right lower column, line 9 to page 193, right lower column, line 10 | Page 37, from left upper column, last line to right lower column, line 13 | From page 65, line 32 to page 66, line 17 |
| Surfactants | From page 201, left lower column, line 1 to page 210, right upper column, last one | From page 18, right upper column, line 1 to page 24, right lower column, last line; and page 27, from left lower column, line 10 from below to right lower column, line 9 | — |
| Fluorine-containing Compounds (as antistatic agents, coating aids, lubricants, and anti-blocking agents) | From page 210, left lower column, line 1 to page 222, left lower column, line 5 | From page 25, left upper column, line 1 to page 27, right lower column, line 9 | |
| Binders (hydrophilic colloids) | From page 222, left lower column, line 6 to page 225, left upper column, last line | Page 38, right upper column, lines 8 to 18 | Page 66, lines 23 to 28 |
| Tackifers | From page 225, right upper column, line 1 to page 227, right upper column, line 2 | — | — |

-continued

| Photographic Elements | JP-A 62-215272 | JP-A 2-33144 | EP 0,355,660A2 |
|---|---|---|---|
| Antistatic Agents | From page 227, right upper column, line 3 to page 230, left upper column, line 1 | — | — |
| Polymer Latexes | From page 230, left upper column, line 2 to page 239, last line | — | — |
| Mat Agents | Page 240, from left upper column, line 1 to right upper column, last line | — | — |
| Photographic Processing Methods (Processing steps and additives) | From page 3, right upper column, line 7 to page 10, right upper column, line 5 | From page 39, left upper column, line 4 to page 42, left upper column, last line | From page 67, line 14 to page 69, line 28 |

Notes:
The cited specification of JP-A-62-215272 is that amended by the letter of amendment filed on March 16, 1987.
As yellow couplers, preferred are so-called short-waved yellow couplers such as those described in JP-A-63-231451, JP-A-63-123047, JP-A-63-241547, JP-A-1-173499, JP-A-1-213648 and JP-A-1-250944.

The silver halide for use in the present invention includes, for example, silver chloride, silver bromide, silver chlorobromide, silver iodochlorobromide and silver iodobromide. Preferred for the purpose of rapid processing of the photographic material of the present invention, is a silver chlorobromide emulsion substantially free of silver iodide and having a silver chloride content of 90 mol % or more, more preferably 95 mol % or more, with a 98 mol % or more, or a pure silver chloride emulsion being especially preferred.

The photographic material of the present invention preferably contains, for the purpose of improving the sharpness of the image to be formed, dye(s) capable of being decolored by photographic processing such as those described in European Patent 0,337,490A2, pages 27 to 76, especially oxonole dyes, in the hydrophilic colloid layers in such a way that the optical reflection density of the material at 680 nm is 0.70 or more. Alternatively the material contains titanium oxide surface-treated with a dihydric to tetrahydric alcohol (e.g., trimethylolethane) in a amount of 12 % by weight or more, more preferably 14% by weight or more, in the water-proofing resin layer of the support.

It is also preferred that the photographic material of the present invention contains a color image preservability improving compound such as those described in European Patent 0,277,589A2 with the couplers. In particular, the combination of such a compound and pyrazoloazole magenta couplers is preferred.

Specifically, preferred is incorporation of (i) a compound which may bond with an aromatic amine developing agent as remained in the color-developed photographic material and which is chemically inactive and substantially colorless, such as those described in European Patent 0,277,589A2 and/or (ii) a compound which may bond with an oxidation product of an aromatic amine developing agent remaining in the color-developed photographic material and which is chemically inactive and substantially colorless compound such as those described in European Patent 0,277,589A2, into the photographic material of the present invention. This is because the incorporation is effective for preventing generation of stains or other harmful side effects in the processed photographic material due to formation of coloring dyes by reaction of the remaining color developing agent or the oxidation product thereof with couplers during storage of the processed photographic material.

The photographic material of the present invention preferably contains a microbicide such as those described in JP-A-63-271247, for the purpose of preventing propagation of various fungi and bacteria to deteriorate the image to be formed, in the hydrophilic colloid layers.

The support of the photographic material of the present invention may be a white polyester support or a support having a white pigment-containing layer on its surface to be coated with silver halide emulsion layers, for display use. In addition, for the purpose of improving the sharpness of the image to be formed, the support preferably has an anti-halation layer on its surface to be coated with silver halide emulsion layer or on its back surface opposite to the said surface. In particular, the transmission density of the support preferably falls within the range of from 0.35 to 0.8 in order that the display may be viewed by either a reflected light or a transmitted light.

The silver halide photographic material of the present invention may be exposed to visible rays or infrared rays. For exposure of the material, either low-intensity exposure or high-intensity short-time exposure may be employed. Especially for the latter case, preferred is a laser-scanning exposure system having an exposure time of shorter than 10–4 second per pixel.

For exposure of the material, a band-pass filter such as that described in U.S. Pat. No. 4,880,726 is preferably employed. By using it, light stain may be prevented during exposure and the color reproducibility of the exposed material is noticeably improved.

The technology of the present invention is preferably applied to a photographic material not containing a color developing agent (for example, paraphenylenediamine derivatives) prior to color development. For instance, it may be applied to a color paper, color reversal paper, a direct positive color photographic material, a color negative film, a color positive film and a color reversal film. Of them, a color photographic material having a reflective support (e.g., color paper, color reversal paper) and a color photographic material of forming a positive image (e.g., direct positive color photographic material, color positive film, color reversal film) are preferred. Especially preferred is a color photographic material having a reflective support.

In order to carry out the present invention, combination of a cyan dye-forming coupler, a magenta dye-forming coupler and an yellow dye-forming coupler of coloring cyan, magenta and yellow, respectively, by coupling reaction with an oxidation product of an aromatic primary amine color-developing agent is preferably employed.

The couplers for the combination may be either 4-equivalent ones or 2-equivalent ones to the silver ion.

The individual couplers for the combination may either be employed singly or as a mixture of two or more of them.

Preferred couplers for use in the present invention are mentioned below.

As cyan couplers for use in the present invention, mentioned are phenol couplers and naphthol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, West German Patent 3,329,729, European Patents 121,365A, 249,453A, 333,185A2, U.S. Pat. Nos. 3,446,622, 4,333,999, 4,775,616, 4,451,559, 4,427,767, 4,690,889, 4,254,212, 4,296,199, and JP-A-61-42658. Also usable are azole couplers such as those described in JP-A-64-553, JP-A-64-554, JP-A-64-555, JP-A-64-556, European Patents 488,248, 491,197, 484,909 and 456,226; imidazole couplers such as those described in U.S. Pat. No. 4,818,672 and JP-A-2-33144; and cyclic active methylene cyan couplers such as those described in JP-A-64-32260.

Especially preferred are couplers of formulae (C-I) and (C-II) as described in JP-A-2-139544, from page 17, left bottom column to page 20, left bottom column and also couplers as described in European Patents 488,248, 491,197, 484,909 and 456,226.

As magenta couplers, 5-pyrazolone compounds and pyrazoloazole compounds are preferred. Especially preferred are those described in U.S. Pat. Nos. 4,310,619, 4,351,897, European Patent 73,636, U.S. Pat. Nos. 3,061,432, 3,725,067, Research Disclosure No. 24220 (June, 1984), JP-A-60-33552, Research Disclosure No. 24230 (June, 1984), JP-A-60-43659, JP-A-61-72238, JP-A-60-35730, JP-A-55-118034, JP-A-60-185951, U.S. Pat. Nos. 4,500,630, 4,540,654, 4,556,630 and International Patent Laid-Open No. WO88/04795.

More preferred are pyrazoloazole magenta couplers of formula (I) described in JP-A-2-139544, from page 3, right bottom column to page 10, right bottom column and 5-pyrazolone magenta couplers of formula (M-I) as described in JP-A-2-139544, from page 17, left bottom column to page 21, left bottom column. Most preferred are the above-mentioned pyrazoloazole magenta couplers.

As yellow couplers, suitable examples include those described in U.S. Pat. Nos. 3,933,501, 4,022,620, 4,326,024, 4,401,752, 4,248,961, JP-B-58-10739, British Patents 1,425,020, 1,476,760, U.S. Pat. Nos. 3,973,968, 4,314,023, 4,511,649, 5,118,599, European Patent 249,473A, JP-A-63-23145, JP-A-63-123047, JP-A-1-250944, JP-A-1-213648.

Preferred are those yellow couplers of formula (Y) as described in JP-A-2-139544, from page 18, left bottom column to page 22, left bottom column, acylacetamide yellow couplers characterized by its acyl group as described in JP-A-5-2248 and European Patent Application Laid-Open No. 0447969, and yellow couplers of formula (Cp-2) as described in JP-A-5-27389 and European Patent Application Laid-Open No. 0446863A2.

Couplers capable of releasing a photographically useful residue along with coupling may also be employed in the present invention. For instance, DIR couplers capable of releasing a development inhibitor are described in the patent publications as referred to in the above-mentioned RD No. 17643, Item VII-F, as well as those described in JP-A-57-151944, JP-A-57-154234, JP-A-60-184248 and JP-A-63-37346, and U.S. Pat. Nos. 4,248,962 and 4,782,012 are preferred.

Couplers capable of imagewise releasing a nucleating agent or development accelerator during development, include those described in British Patents 2,097,140 and 2,131,188, and JP-A-59-157638 and JP-A-59-170840 are preferred.

Suitable examples of couplers which may be incorporated into the photographic materials of the present invention, include competing couplers described in U.S. Pat. No. 4,130,427; poly-valent couplers described in U.S. Pat. Nos. 4,238,472, 4,338,393 and 4,310,618; DIR redox compound-releasing couplers, DIR coupler-releasing couplers, DIR coupler-releasing redox compounds and DIR redox-releasing redox compounds described in JP-A-60-185950 and JP-A-62-24252; couplers of releasing a dye which recolors after released from the coupler, as described in European Patent 173,302A; bleaching accelerator-releasing couplers described in RD Nos. 11449 and 24241 and JP-A-61-201247; ligand-releasing couplers described in U.S. Pat. No. 4,553,477; leuco dye-releasing couplers described in JP-A-63-75747; and couplers of releasing a phosphor dye as described in U.S. Pat. No. 4,774,181.

The standard amount of the color couplers incorporated into the photographic materials of the present invention is from 0.001 to 1 mol per mol of light-sensitive silver halide. Preferably, the amount of yellow couplers may be from 0.01 to 0.5 mol per mol of silver halide; that of magenta couplers may be from 0.003 to 0.3 mol per the same; and that of cyan couplers may be from 0.002 to 0.3 mol per the same.

Examples of typical couplers for use in the present invention are mentioned below.

(Y-1)

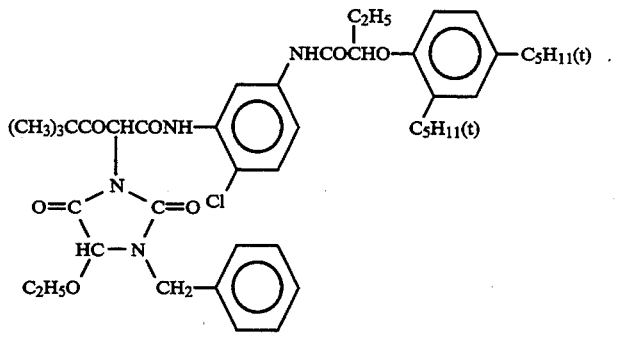

-continued
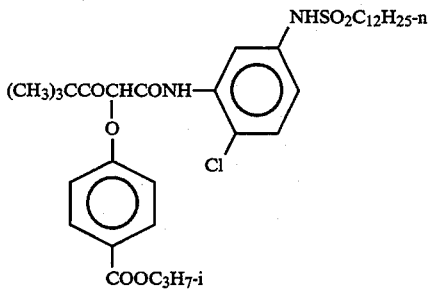
(Y-2)
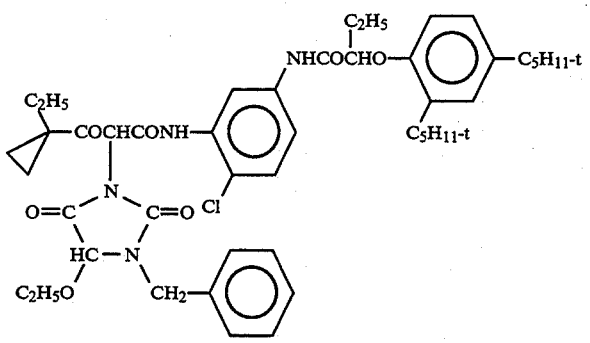
(Y-3)
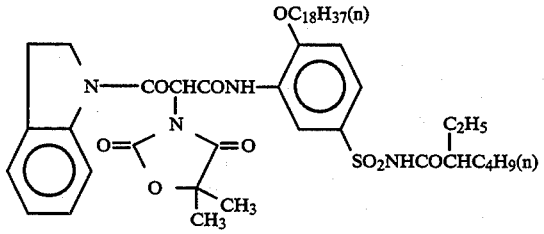
(Y-4)
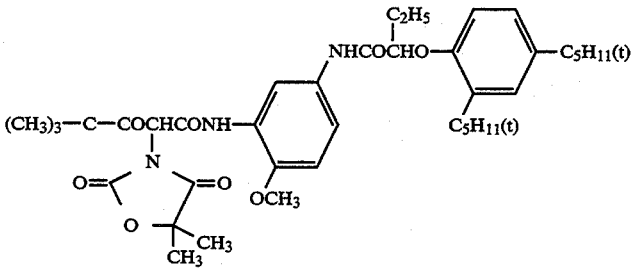
(Y-5)
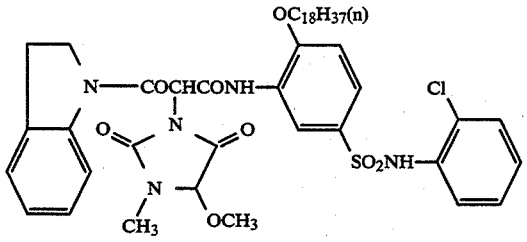
(Y-6)

-continued
(Y-7)
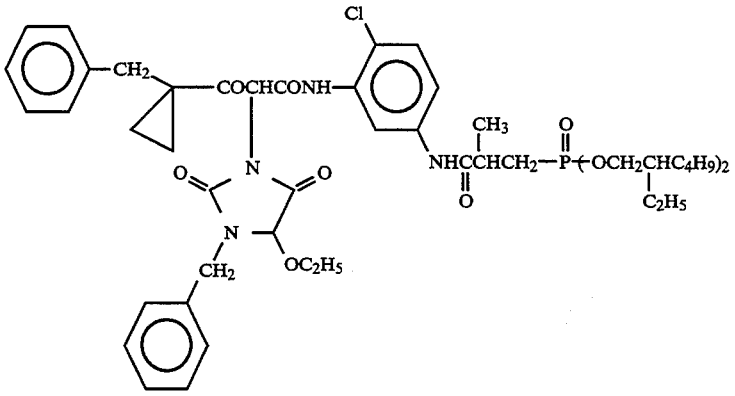
(Y-8)
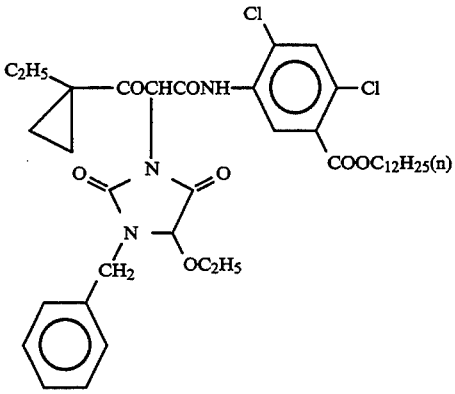
(M-1)
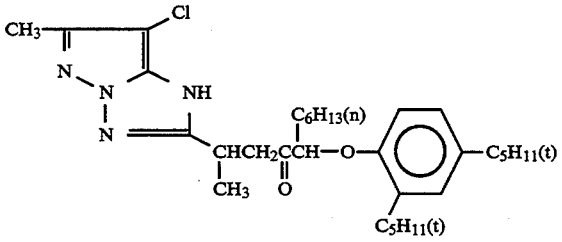
(M-2)
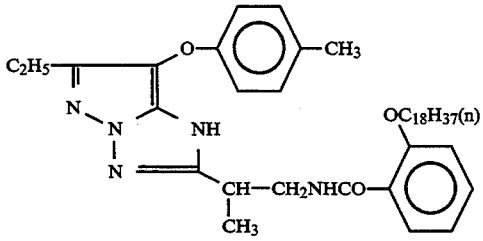
(M-3)
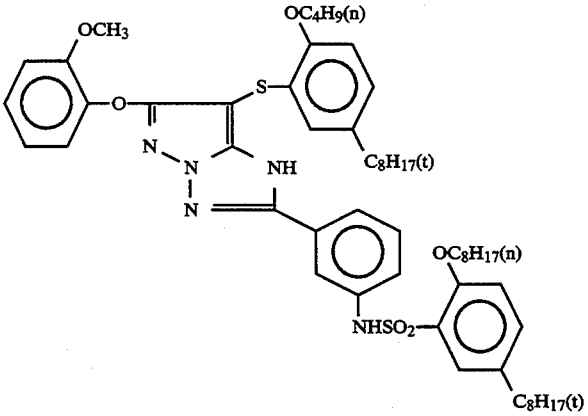

-continued
(M-4)
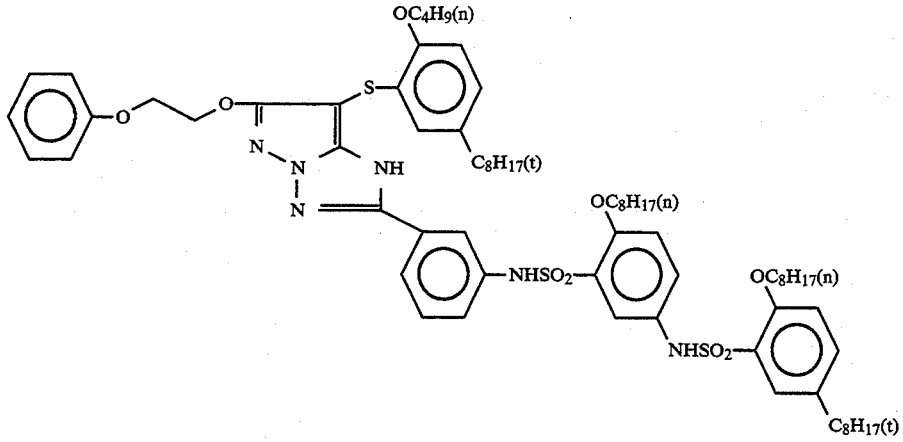
(M-5)
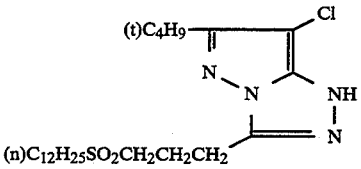
(M-6)
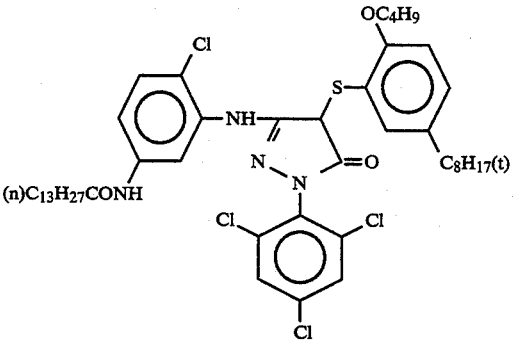
(M-7)
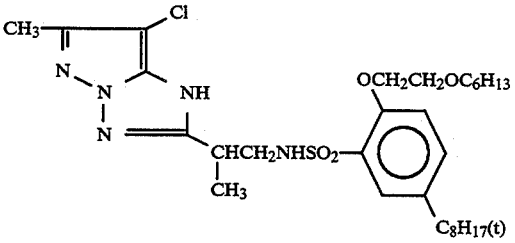
(M-8)
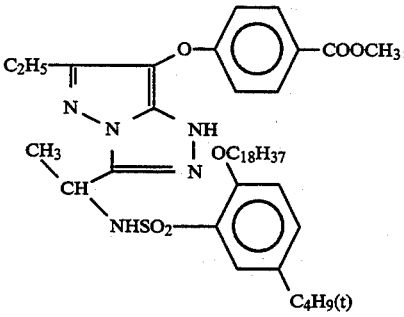

-continued
(M-9)
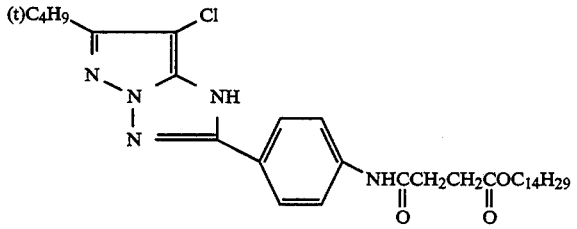
(C-1)
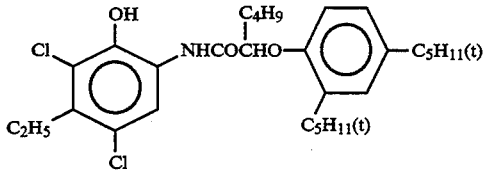
(C-2)
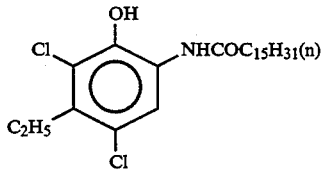
(C-3)
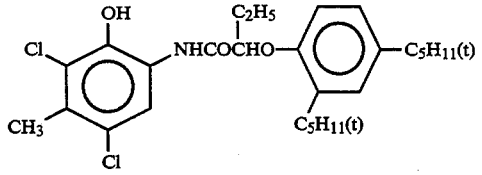
(C-4)
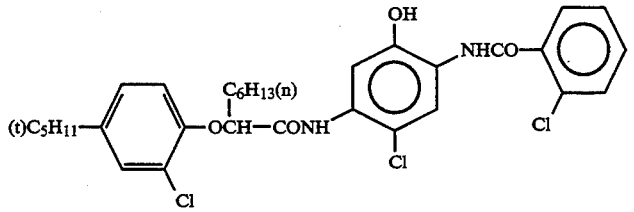
(C-5)
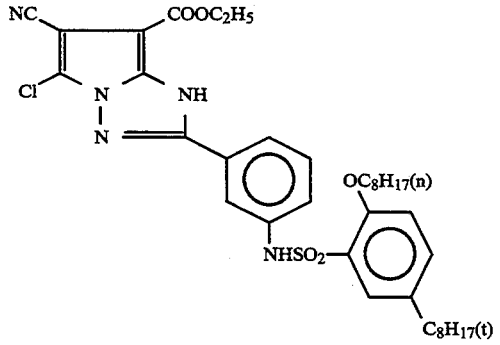
(C-6)
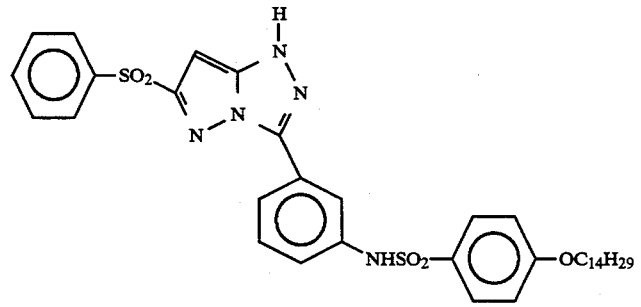

-continued
(C-7)
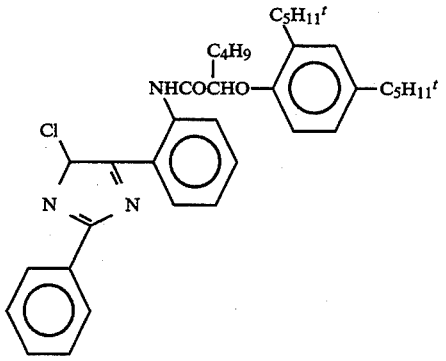
(C-8)
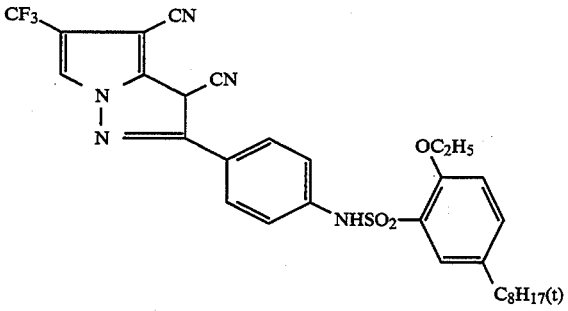
(C-9)
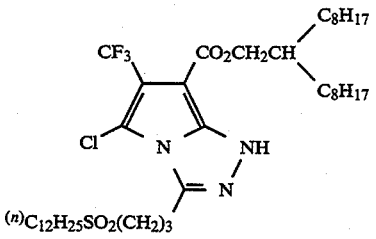
(C-10)
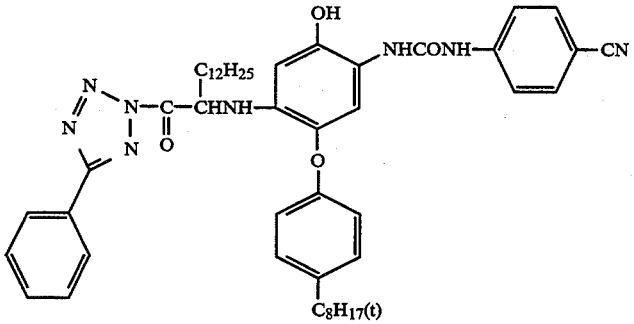
(C-11)
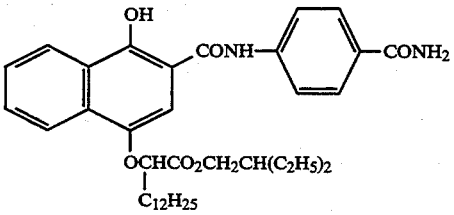

-continued (C-12)

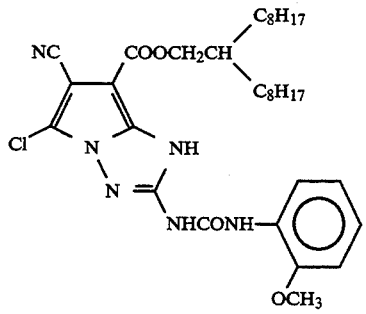

(C-13)

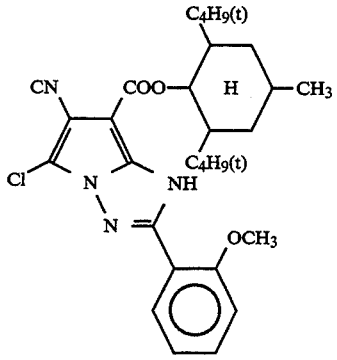

The photographic materials of the present invention can contain various anti-fading agents. Suitable examples of organic anti-fading agents for cyan, magenta and/or yellow images include, for example, hydroquinones, 6-hydroxychromanes, 5-hydroxycoumarans, spirochromans, p-alkoxyphenols, hindered phenols such as bisphenols, gallic acid derivatives , methylenedioxybenzenes, aminophenols, hindered amines and their ether or ester derivatives to be formed by silylating, acylating or alkylating the phenolic hydroxyl group of the compounds. In addition, various metal complexes such as (bissalicylaldoximato)nickel complexes and (bis-N,N-dialkyldithiocarbamato)nickel complexes can also be used.

Specific examples of organic anti-fading agents usable in the present invention, include hydroquinones described in U.S. Pat. Nos. 2,360,290, 2,418,613, 2,700,453, 2,701,197, 2,728,659, 2,732,300, 2,735,765, 3,982,944 and 4,430,425, British Patent 1,363,921, and U.S. Pat. Nos. 2,710,801 and 2,816,029; 6-hydroxychromanes, 5hydroxychromanes and spirochromans as described in U.S. Pat. Nos. 3,432,300, 3,573,050, 3,574,627, 3,698,909 and 3,764,337, and JP-A-52-152225; spiroindanes described in U.S. Pat. No. 4,360,589; p-alkoxyphenols described in U.S. Pat. No. 2,735,765, British Patent 2,066,975, JP-A-59-10539, and JP-B-57-19765; hindered phenols described in U.S. Pat. Nos. 3,700,455 and 4,228,235, JP-A-52-72224 and JP-B-52-6623; gallic acid derivatives described in U.S. Pat. No. 3,457,079; methylenedioxybenzenes described in U.S. Pat. No. 4,332,886; aminophenols described in JP-B-56-21144; hindered amines described in U.S. Pat. Nos. 3,336,135 and 4,268,593, British Patents 1,326,889, 1,354,313 and 1,410,846, JP-B-51-1420, JP-A-58-114036, 59-53846 and 5978344; and metal complexes described in U.S. Pat. Nos. 4,050,938 and 4,241,155, and British Patent 2,027,731(A). These compounds are added to the photographic layers of the present invention in an amount of, generally, from 5 to 100% by weight to the corresponding color couplers, in the form of a co-emulsion with couplers.

The photographic material of the present invention may contain, as a color-fogging preventing agent, hydroquinone derivatives, aminophenol derivatives, gallic acid derivatives and ascorbic acid derivatives.

For the purpose of inhibiting deterioration of cyan color images by heat and especially by light, an ultraviolet absorbent may effectively be incorporated into the cyan coloring layer and both adjacent layers.

Suitable examples of ultraviolet absorbents include aryl-substituted benzotriazole compounds (such as those described in U.S. Pat. No. 3,533,794), 4-thiazolidone compounds (such as those described in U.S. Pat. Nos. 3,314,794 and 3,352,681), benzophenone compounds (such as those described in JP-A-46-2784), cinnamate compounds (such as those described in U.S. Pat. Nos. 3,705,805 and 3,707,395), butadiene compounds (such as those described in U.S. Pat. No. 4,045,229), triazine compounds (such as those described in JP-A-46-3335) and benzoxazole compounds (such as those described in U.S. Pat. Nos. 3,406,070 and 4,271,307). Ultraviolet absorbing couplers (for example, cyan dye forming $\alpha$-naphthol couplers) and ultraviolet absorbing polymers may also be used. These ultraviolet absorbents may be mordanted in particular layers. Above all, the above-mentioned aryl-substituted benzotriazoles are preferred.

The photographic material of the present invention can be processed in accordance with ordinary methods such as those described in the above-mentioned RD No. 17643, pages 28 to 29 and ibid., No. 18716, page 615, from left column to right column. For instance, the material is processed by a process comprising a color development step, a desilvering step and a rinsing step. In the desilvering step, bleach-fixation with a bleach-fixing solution may be effected in place of the combination of bleaching with a bleaching solution and fixation with a fixing solution. As the case may be, a bleaching step, a fixing step and a bleach-fixing step may be combined in any desired order. A stabilization step may be effected in place of the rinsing step. Alternatively, a stabilization step may be effected after the rinsing step. In addition, a mono-bath processing system may be employed in which color development, bleaching and fixation are effected in one bath.

In combination with the above-mentioned processing steps, a pre-hardening step, a subsequent neutralizing step, a stopping and fixing step, a post-hardening step, a compensating step and an intensifying step may also be effected, if desired. Between any or all of the above-mentioned steps, an optional intermediate rinsing step may be effected. A so-called activator processing step may be effected in place of the color development step.

For the sake of completeness and brevity, each of the above dislosed patents and applications are hereby incorporated by reference herein in their entirety for all purposes.

The present invention will be explained in more detail by way of the following examples, which, however, are not intended to restrict the scope of the present invention.

EXAMPLE 1

16.1 of an yellow coupler (Y-1) was weighed, 10.1 g of a high boiling point organic solvent, dibutyl phthalate, was added thereto and 24 ml of ethyl acetate was added thereto to dissolve the coupler. The resulting solution was emulsified and dispersed in 200 g of 10 wt. % aqueous gelatin solution containing 1.5 g of sodium dodecylbenzenesulfonate.

The emulsified dispersion was added in its entirety to 247 g of high silver chloride emulsion (containing 70.0 g of silver per kg of emulsion and having a silver bromide content of 0.5 mol %), and the resulting emulsion was coated on a subbing layer-coated triacetate film base in an amount of 1.73 g/m2 as silver. Over the emulsion layer coated was a gelatin layer, as a protective layer, to have a dry thickness of 1.0μ. The thus coated sample was sample No. 101. As a gelatin hardening agent, used was 1-hydroxy-3,5-dichloro-s-triazine sodium salt.

Samples Nos. 102 to 140 were prepared in the same manner as in preparation of sample No. 101, except that a combination of a coupler and a color image stabilizer (in an amount of 100 mol % to the coupler) as indicated in Table A below was used to prepare a co-emulsified dispersion in place of the emulsified dispersion.

The samples thus prepared were wedgewise exposed and then developed in accordance with the process mentioned below.

| Process for Development: | | |
|---|---|---|
| Step | Temperature | Time |
| Color Development | 35° C. | 45 sec |
| Bleach-fixation | 35° C. | 45 sec |
| Rinsing (1) | 35° C. | 30 sec |
| Rinsing (2) | 35° C. | 30 sec |
| Rinsing (3) | 35° C. | 30 sec |
| Drying | 80° C. | 60 sec |

Rinsing was effected by a three-tank countercurrent system from the rinsing tank (3) to the rinsing tank (1).

Compositions of the processing solutions used in the steps are mentioned below.

| | |
|---|---|
| Color Developer: | |
| Water | 800 ml |
| N-ethyl-N-(β-methanesulfonamidoethyl)-3-methyl-4-aminoaniline 3/2 sulfate monohydrate | 5.0 g |
| Ethylenediaminetetraacetic Acid | 3.0 g |
| Disodium 4,5-Dihydroxybenzene-1,3-disulfoate | 0.5 g |
| Triethanolamine | 12.0 g |
| Potassium Chloride | 2.5 g |
| Potassium Bromide | 0.01 g |
| Potassium Carbonate | 27.0 g |
| Brightening Agent (WHITEX 4B, produced by Sumitomo Chemical Co.) | 1.0 g |
| Sodium Sulfite | 0.1 g |
| Disodium N,N-bis(sulfonatoethyl)hydroxylamine | 5.0 g |
| Water to make | 1000 ml |
| pH (with potassium hydroxide and sulfuric acid, at 25° C.) | 10.05 |
| Bleach-fixing Solution: | |
| Water | 600 ml |
| Ammonium Thiosulfate (700 g/liter) | 100 ml |
| Sodium Sulfite | 40 g |
| Ammonium Ethylenediaminetetraacetate/Fe(III) | 55 g |
| Disodium Ethylenediaminetetraacetate | 5 g |
| Ammonium Bromide | 40 g |
| Nitric Acid (67%) | 30 g |
| Water to make | 1000 ml |
| pH (with acetic acid and aqueous ammonia, at 25° C.) | 5.8 |
| Rinsing Solution: | |
| Sodium Chloroisocyanurate | 0.02 g |
| De-ionized Water (having a conductivity of 5 μs/cm or less) | 1000 ml |
| pH | 6.5 |

The samples Nos. 101 to 140 each having a color image formed were exposed to light with a xenon tester (having an illuminance of 200,000 lux) for 12 days, via an ultraviolet absorbing filter to cut off light of 400 nm or less (manufactured by Fuji Photo Film Co.). The thus exposed samples were evaluated with respect to the percentage of the residual density at the area having an initial density of 2.0. Measurement of the density was effected with a Fuji Automatic Densitometer. The results obtained are shown in Table A below.

TABLE A

| Sample No. | Coupler | Color Image Stabilizer | Percentage of Residual Yellow Density (initial density 2.0; after 200,000-lux Xe for 12 days) | Remarks |
|---|---|---|---|---|
| 101 | Y-1 | — | 48% | comparative sample |
| 102 | Y-1 | comparative compound (a) | 44 | comparative sample |
| 103 | Y-1 | comparative compound (b) | 55 | comparative sample |
| 104 | Y-1 | A-1 | 78 | sample of the invention |
| 105 | Y-1 | A-3 | 79 | sample of the invention |
| 106 | Y-1 | A-10 | 80 | sample of the invention |
| 107 | Y-1 | A-12 | 77 | sample of the invention |
| 108 | Y-1 | A-14 | 79 | sample of the invention |

TABLE A-continued

| Sample No. | Coupler | Color Image Stabilizer | Percentage of Residual Yellow Density (initial density 2.0; after 200,000-lux Xe for 12 days) | Remarks |
|---|---|---|---|---|
| 109 | Y-1 | A-16 | 80 | sample of the invention |
| 110 | Y-3 | — | 30 | comparative sample |
| 111 | Y-3 | comparative compound (a) | 33 | comparative sample |
| 112 | Y-3 | comparative compound (b) | 40 | comparative sample |
| 113 | Y-3 | A-1 | 77 | sample of the invention |
| 114 | Y-3 | A-3 | 79 | sample of the invention |
| 115 | Y-3 | A-10 | 79 | sample of the invention |
| 116 | Y-3 | A-12 | 78 | sample of the invention |
| 117 | Y-6 | — | 35 | comparative sample |
| 118 | Y-6 | comparative compound (b) | 45 | comparative sample |
| 119 | Y-6 | A-1 | 80 | sample of the invention |
| 120 | Y-6 | A-3 | 81 | sample of the invention |
| 121 | Y-6 | A-14 | 80 | sample of the invention |
| 122 | Y-6 | A-16 | 82 | sample of the invention |
| 123 | Y-1 | B-2 | 77 | sample of the invention |
| 124 | Y-1 | B-8 | 75 | sample of the invention |
| 125 | Y-1 | B-11 | 78 | sample of the invention |
| 126 | Y-3 | B-2 | 75 | sample of the invention |
| 127 | Y-3 | B-8 | 74 | sample of the invention |
| 128 | Y-3 | B-12 | 79 | sample of the invention |
| 129 | Y-6 | B-3 | 78 | sample of the invention |
| 130 | Y-6 | B-7 | 73 | sample of the invention |
| 131 | Y-6 | B-13 | 77 | sample of the invention |
| 132 | Y-1 | C-1 | 80 | sample of the invention |
| 133 | Y-1 | C-5 | 82 | sample of the invention |
| 134 | Y-1 | C-7 | 83 | sample of the invention |
| 135 | Y-3 | C-9 | 80 | sample of the invention |
| 136 | Y-3 | C-15 | 79 | sample of the invention |
| 137 | Y-3 | C-19 | 78 | sample of the invention |
| 138 | Y-6 | C-27 | 82 | sample of the invention |
| 139 | Y-6 | C-28 | 79 | sample of the invention |
| 140 | Y-6 | C-1 | 82 | sample of the invention |

The Comparative compounds used above are illustrated below.

Comparative Compound (a)

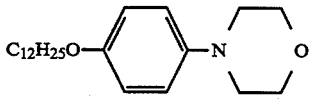

(described in JP-A-63-95439)

Comparative Compound (b)

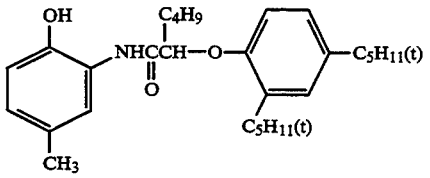

(described in JP-A-61-86750 and U.S. Pat. No. 4,656,125)

From the results, it is clear that compounds of the present invention are effective for preventing color images from fading under light. The effect of the compounds of the present invention could not be expected from similar, known aminophenol derivatives.

EXAMPLE 2

Sample No. 201 was prepared in the same manner as in preparation of sample No. 101 of Example 1, except that 16.1 g of the yellow coupler (Y-1) was replaced by 11.5 g of a magenta coupler (M-1) and 10.1 g of the high boiling point organic solvent dibutyl phthalate was replaced by 11.5 g of the same.

Samples Nos. 202 to 211 were prepared in the same manner as in preparation of sample No. 201, except that a combination of a coupler and a color image stabilizer (in an amount of 100 mol % to the coupler) as indicated in Table B below was used to prepare a co-emulsified dispersion in place of the emulsified dispersion.

Samples Nos. 203 to 209 each further contain Comparative compound (C) in an amount of 100 mol % to the coupler.

The samples thus prepared were exposed and developed in the same manner as in Example 1, and the processed samples were subjected to the same fading test as that in Example 1 whereupon the period for exposure to light in the fading test was 10 days. The tested samples were evaluated with respect to the percentage of the residual density in the area having an initial density of 0.5 or 1.0. The results obtained are shown in Table B below. The comparative compounds were same as those used in Example 1.

TABLE B

| Sample No. | Coupler | Color Image Stabilizer | Percentage of Residual Magenta Density after exposure to 200,000 lux-Xe for 10 days: initial density 0.5 | initial density 1.0 | Remarks |
|---|---|---|---|---|---|
| 201 | M-1 | — | 5% | 7% | comparative sample |
| 202 | M-1 | comparative compound (b) | 20 | 31 | comparative sample |
| 203 | M-1 | comparative compound (b)* | 40 | 63 | comparative sample |
| 204 | M-1 | A-1* | 72 | 79 | sample of the invention |
| 205 | M-1 | A-10* | 74 | 80 | sample of the invention |
| 206 | M-1 | A-16* | 75 | 78 | sample of the invention |
| 207 | M-1 | B-11* | 70 | 75 | sample of the invention |
| 208 | M-1 | C-1* | 75 | 80 | sample of the invention |
| 209 | M-1 | C-9* | 76 | 82 | sample of the invention |
| 210 | M-1 | C-1 | 66 | 73 | sample of the invention |
| 211 | M-1 | comparative compound (c) | 33 | 58 | comparative sample |

Comparative compound (b) is the same as that in Example 1.
*represents that comparative compound (c) is further added in an amount of 100 mol % to a magent coupler (M-1).
Comparative compound (c):

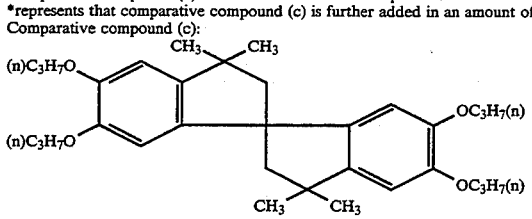

From the results, it is clear that compounds of the present invention are effective for preventing the magenta color image from fading under light and, in particular, they are effective for preventing the image of being within a low density area from fading under light. This effectiveness could not be expected from similar, known, compounds.

Using the same color image stabilizers as those in Table A above, the same xenon fading test as above was effected except that the yellow coupler in Example 1 was replaced by a coupler (C-5). From the test, it was verified that the compounds also had an excellent anti-fading effect to color images formed from (C-5).

EXAMPLE 3

One surface of a paper support, both surfaces of which were laminated with polyethylene, was subjected to corona discharging treatment, and a subbing gelatin layer containing sodium dodecylbenzenesulfonate was provided on the surface and plural photographic layers mentioned below were then coated over the subbing layer to prepare a multi-layer color photographic paper (sample No. 001). Coating compositions for the photographic layers were prepared as mentioned below.

Preparation of Coating Composition for First Layer:

158.0 g of an yellow coupler (ExY), 15.0 g of a color image stabilizer (Cpd-1), 7.5 g of a color image stabilizer (Cpd-2) and 16.0 g of a color image stabilizer (Cpd-3) were dissolved in 25 g of a solvent (Solv-1), 25 g of a solvent (Solv-2) and 180 cc of ethyl acetate, and the resulting solution was dispersed by emulsification in 1000 g of aqueous 10% gelatin solution containing 60 cc of 10% sodium dodecylbenzenesulfonate and 10 g of citric acid to prepare an emulsified dispersion A. On the other hand, a silver chlorobromide emulsion A was prepared, which was a mixture (3/7 as silver molar ratio) comprising a large-size emulsion A of cubic grains having a mean grain size of 0.88 μm and a small-size emulsion A of cubic grains having a mean grain size of 0.70 μm. The two emulsions had a fluctuation coefficient of grain size distribution of 0.08 and 0.10, respectively. They each had 0.3 mol % of silver bromide locally on a part of the surfaces of the grains. Blue-sensitizing dyes A and B mentioned below were added to the mixture emulsion in an amount of $2.0\times10^{-4}$ mol per mol of silver to the large-size emulsion A and $2.5\times10^{-4}$ mol per mol of silver to the small-size emulsion A. Then, the mixture emulsion was chemical-sensitized with a sulfur sensitizer and a gold sensitizer. The previously prepared emulsified dispersion A and the silver chlorobromide mixture emulsion A were blended to obtain a coating composition for the first layer, which comprised the components illustrated below. The amount of the emulsion coated indicates the amount of silver therein.

Other coating compositions for the second layer to the seventh were prepared in the same manner as above. 1-Hydroxy-3,5-dichloro-s-triazine sodium salt was used as the gelatin hardening agent for each layer.

Each layer contained 25.0 mg/m$^2$ of Cpd-14 and 50.0 mg/m$^2$ of Cpd-15.

The following color sensitizing dyes were added to the silver chlorobromide emulsions for the respective light-sensitive layers.

Blue-sensitive Emulsion Layer:

Sensitizing Dye A:

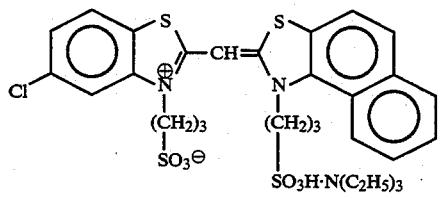

and

Sensitizing Dye B:

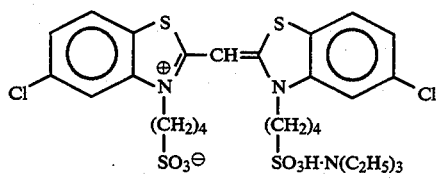

(Both were added, each in an amount of $2.0\times10^{-4}$ mol per mol of silver halide to the large-size emulsion and $2.5\times10^{4}$ mol per mol of silver halide to the small-size emulsion.)

Green-sensitive Emulsion Layer:

Sensitizing Dye C:

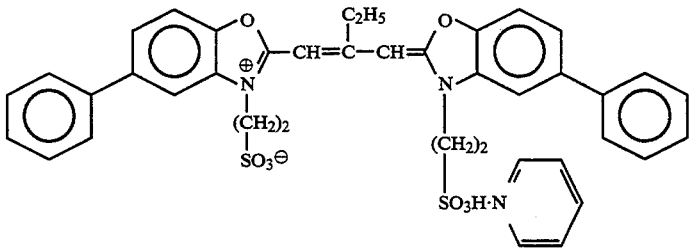

(This was added in an amount of $4.0\times10^{-4}$ mol per mol of silver halide to the large-size emulsion and $5.6\times10^{-4}$ mol per mol of silver halide to the small-size emulsion.) and Sensitizing Dye D:

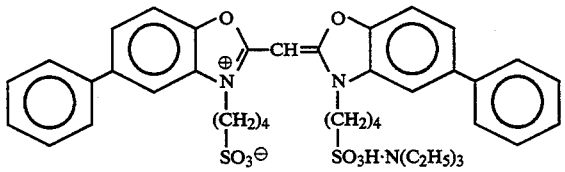

(This was added in an amount of $7.0\times10^{-5}$ mol per mol of silver halide to the large-size emulsion and $1.0\times10^{-5}$ mol per mol of silver halide to the small-size emulsion.)

Red-sensitive Emulsion Layer:

Sensitizing Dye E:

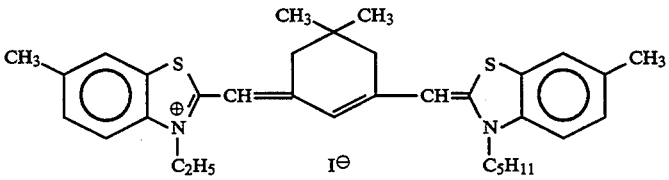

(This was added in an amount of $0.9\times10^{-4}$ mol per mol of silver halide to the large-size emulsion and $1.1\times10^{-4}$ mol per mol of silver halide to the small-size emulsion.)

To the red-sensitive emulsion layer was added the following compound F in an amount of $2.6\times10^{-3}$ mol per mol of silver halide.

Compound F:

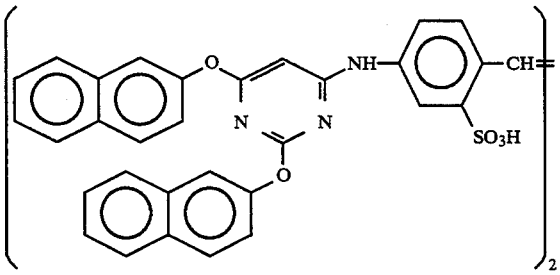

To each of the blue-sensitive emulsion layer, green-sensitive emulsion layer and red-sensitive emulsion layer was added 1-(5-methylureidophenyl)-5-mercaptotetrazole in an amount of $8.5\times10^{-5}$ mol, $7.7\times10^{-4}$ mol and $2.5\times10^{-4}$ mol, each per mol of silver halide, respectively. To each of the blue-sensitive emulsion layer and green-sensitive emulsion layer was added 4-hydroxy-6-methyl-1,3,3a,7-tetrazaindene in an amount of $1\times10^{-4}$ mol, $2\times10^{-4}$ mol, each per mol of silver halide, respectively. The following dyes were added to each emulsion layer for anti-irradiation. (The amount as parenthesized indicate the amount of each dye coated.)

(10 mg/m²)

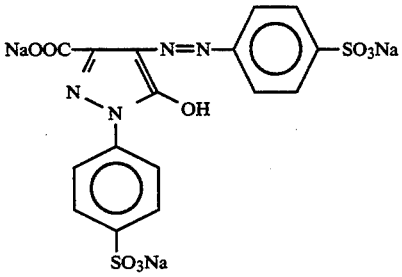

-continued

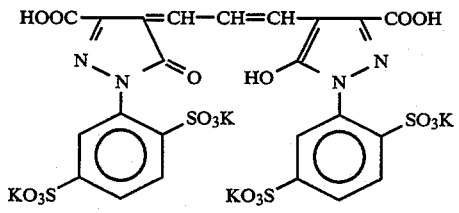

(10 mg/m²)

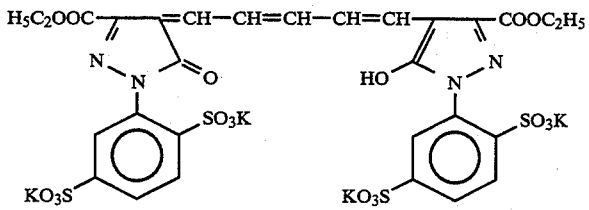

(40 mg/m²)

and

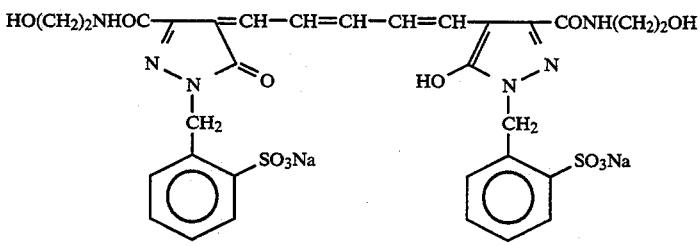

(20 mg/m²)

Layer Constitution of Photographic Material Sample:

The composition of each layer of the photographic material sample is mentioned below. The number indicates the amount of the component coated in g/m². The amount of the silver halide emulsion coated is represented by the amount of silver therein coated.

| | |
|---|---|
| Support | |
| Polyethylene-laminated Paper (containing white pigment ($TiO_2$) and bluish dye (ultramarine) in polyethylene below the first layer) | |
| First Layer (Blue-sensitive Emulsion Layer): | |
| Above-mentioned Silver Chlorobromide Emulsion A | 0.27 |
| Gelatin | 1.36 |
| Yellow Coupler (ExY) | 0.79 |
| Color Image Stabilizer (Cpd-1) | 0.08 |
| Color Image Stabilizer (Cpd-2) | 0.04 |
| Color Image Stabilizer (Cpd-3) | 0.08 |
| Solvent (Solv-1) | 0.13 |
| Solvent (Solv-2) | 0.13 |
| Second Layer (Color Mixing Preventing Layer): | |
| Gelatin | 1.00 |
| Color Mixing Preventing Agent (Cpd-4) | 0.06 |
| Solvent (Solv-7) | 0.03 |
| Solvent (Solv-2) | 0.25 |
| Solvent (Solv-3) | 0.25 |
| Third Layer (Green-sensitive Emulsion Layer): | |
| Silver Chlorobromide Emulsion (1/3 (as silver molar ratio) mixture comprising a large-size emulsion B of cubic grains with a mean grain size of 0.55 μm and a small-size emulsion B of cubic grains with a mean grain size of 0.39 μm; the two emulsions each having a fluctuation coefficient of grain size distribution of 0.10 and 0.08, respectively, and each having 0.8 mol % of AgBr locally on the surfaces of the grains) | 0.13 |
| Gelatin | 1.45 |
| Magenta Coupler (ExM) | 0.16 |
| Color Image Stabilizer (Cpd-5) | 0.15 |
| Color Image Stabilizer (Cpd-2) | 0.03 |
| Color Image Stabilizer (Cpd-6) | 0.01 |
| Color Image Stabilizer (Cpd-7) | 0.01 |

-continued

| | |
|---|---|
| Color Image Stabilizer (Cpd-8) | 0.08 |
| Solvent (Solv-3) | 0.50 |
| Solvent (Solv-4) | 0.15 |
| Solvent (Solv-5) | 0.15 |
| Fourth Layer (Color Mixing Preventing Layer): | |
| Gelatin | 0.70 |
| Color Mixing Preventing Agent (Cpd-4) | 0.04 |
| Solvent (Solv-7) | 0.02 |
| Solvent (Soly-2) | 0.18 |
| Solvent (Solv-3) | 0.18 |
| Fifth Layer (Red-sensitive Layer): | |
| Silver Chlorobromide Emulsion (1/3 (as silver molar ratio) mixture comprising a large-size emulsion C of cubic grains with a mean grain size of 0.50 μm and a small-size emulsion C of cubic grains with a mean grain size of 0.41 μm; the two emulsions each having a fluctuation coefficient of grain size distribution of 0.09 and 0.11, respectively, and each having 0.8 mol % of AgBr locally on the surfaces of the grains) | 0.20 |
| Gelatin | 0.85 |
| Cyan Coupler (ExC) | 0.33 |
| Ultraviolet Absorbent (UV-2) | 0.18 |
| Color Image Stabilizer (Cpd-1) | 0.30 |
| Color Image Stabilizer (Cpd-9) | 0.01 |
| Color Image Stabilizer (Cpd-10) | 0.01 |
| Color Image Stabilizer (Cpd-11) | 0.01 |
| Solvent (Solv-6) | 0.22 |
| Color Image Stabilizer (Cpd-8) | 0.01 |
| Color Image Stabilizer (Cpd-6) | 0.01 |
| Solvent (Solv-1) | 0.01 |
| Sixth Layer (Ultraviolet Absorbing Layer): | |
| Gelatin | 0.55 |
| Ultraviolet Absorbent (UV-1) | 0.38 |
| Color Image Stabilizer (Cpd-12) | 0.15 |
| Color Image Stabilizer (Cpd-5) | 0.02 |
| Seventh Layer (Protective Layer): | |
| Gelatin | 1.13 |
| Acryl-modified Copolymer of Polyvinyl Alcohol (modification degree 17%) | 0.05 |
| Liquid Paraffin | 0.02 |

-continued

| | |
|---|---|
| Color Image Stabilizer (Cpd-13) | 0.01 |

The compounds used above are mentioned below.

(ExY) Yellow Coupler:
1/1 (by mol) mixture of the following:

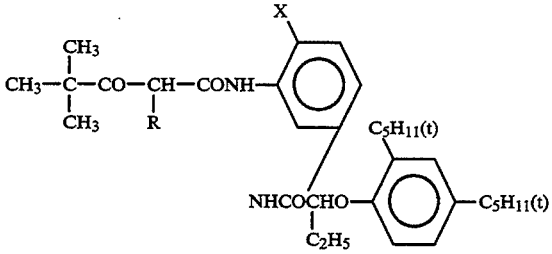

R = 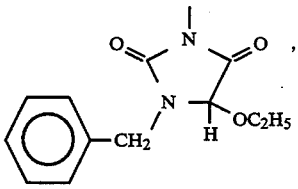 , X = Cl

R = 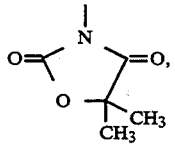 , X = $OCH_3$ (ExM) Magenta Coupler:

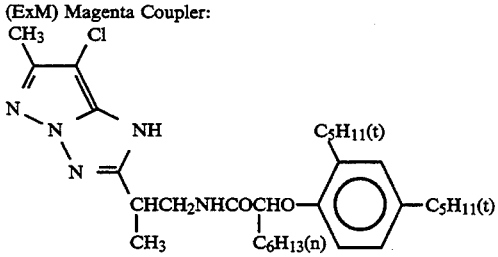

(ExC) Cyan Coupler:
3/7 (by mol) mixture of the following:

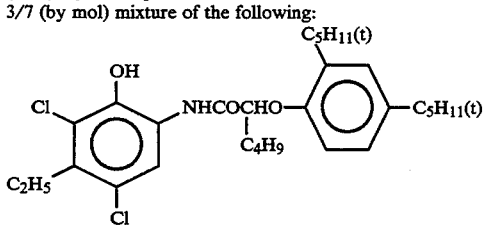

and

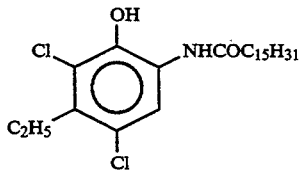

(Cpd-1) Color Image Stabilizer:

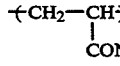

mean molecular weight: 60,000

-continued (Cpd-2) Color Image Stabilizer:

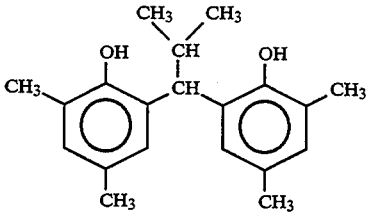

(Cpd-3) Color Image Stabilizer:

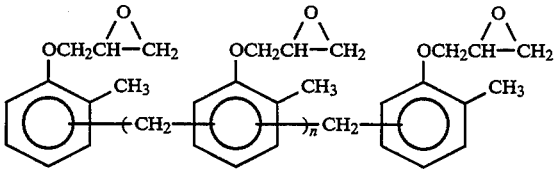

n = 7 to 8 (mean value)

(Cpd-4) Color Image Stabilizer:

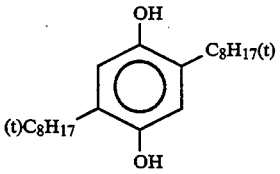

(Cpd-5) Color mixing prevention agent:

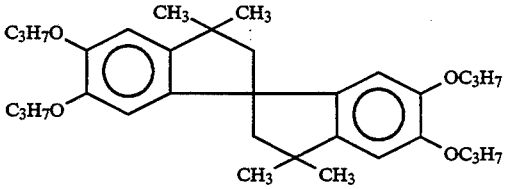

(Cpd-6) Color Image Stabilizer:

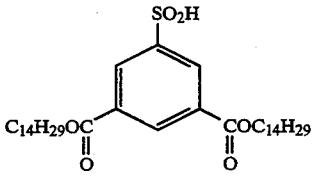

(Cpd-7) Color Image Stabilizer:

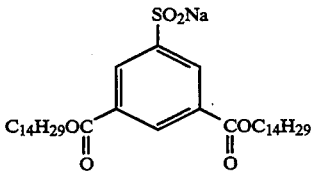

(Cpd-8) Color Image Stabilizer:

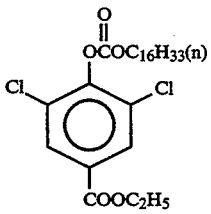

(Cpd-9) Color Image Stabilizer:

-continued

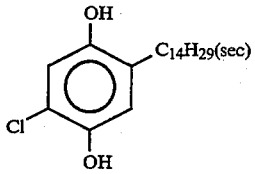

(Cpd-10) Color Image Stabilizer:

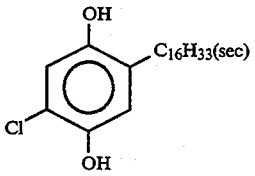

(Cpd-11) Color Image Stabilizer:

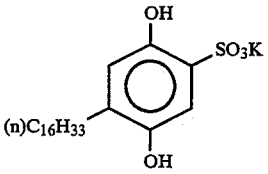

(Cpd-12) Color Image Stabilizer:

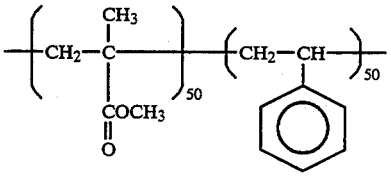

(mol ratio)
mean molecular weight: 60,000

(Cpd-13) Color Image Stabilizer:

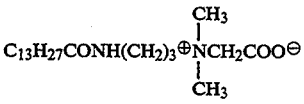

(Cpd-14) Antiseptic:

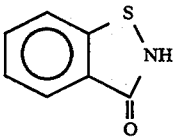

(Cpd-15) Antiseptic:

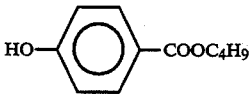

(Solv-1) Solvent:

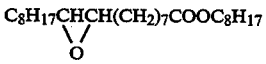

(Solv-2) Solvent:

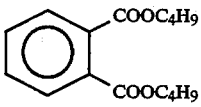

(Solv-3) Solvent:

-continued

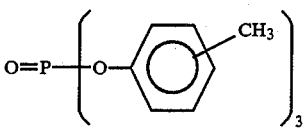

(Solv-4) Solvent:

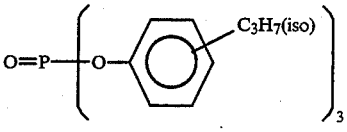

(Solv-5) Solvent:

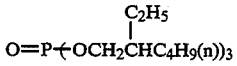

(Solv-6) Solvent:

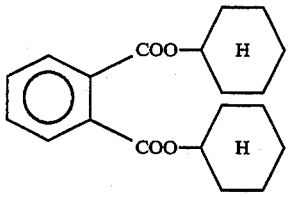

(Solv-7) Solvent:

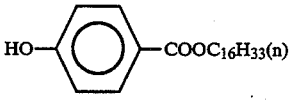

(UV-1) Ultraviolet Absorbent:
1/5/10/15 mixture (by weight) of the following:

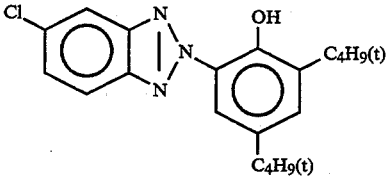

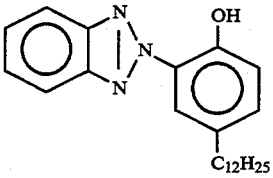

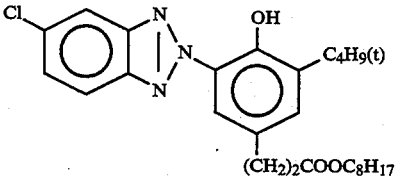

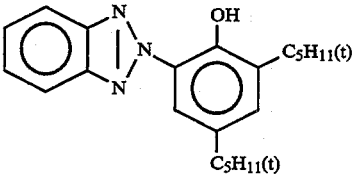

(UV-2) Ultraviolet Absorbent:
1/2/2 mixture (by weight) of the following:

-continued

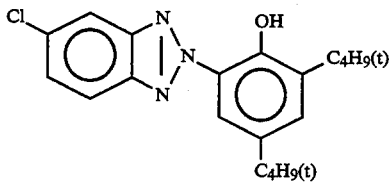

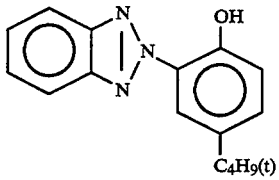

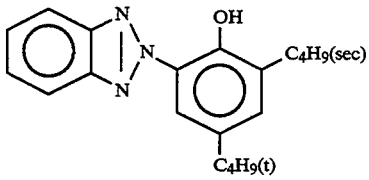

Samples Nos. 002 to 008 were prepared in the same manner as in preparation of sample No. 001, except that an additional color image stabilizer as indicated in Table C below was added to the first layer by co-emulsification with the other color image stabilizers and the yellow coupler ExY. The amount of the additional color image stabilizer was the same molar amount as that of the yellow coupler.

Using a sensitometer (FWH Model, manufactured by Fuji Photo Film Co.; the light source has a color temperature of 3200° K.), the sample No. 001 was subjected to gray exposure in such a way that about 30% by weight of the coated silver could be developed.

The exposed sample was processed continuously with a paper processor using the processing solutions mentioned below, in accordance with the process also mentioned below, whereby a processing system with running equivalence was prepared.

Processing Steps

| | Processing Steps: | | | |
|---|---|---|---|---|
| Step | Temp. | Time | Replenisher (ml) (*) | Tank Capacity (liter) |
| Color Development | 35° C. | 45 sec | 161 | 17 |
| Bleach-Fixation | 30 to 35° C. | 45 sec | 215 | 17 |
| Rinsing | 30° C. | 90 sec | 350 | 10 |

-continued

| | Processing Steps: | | | |
|---|---|---|---|---|
| Step | Temp. | Time | Replenisher (ml) (*) | Tank Capacity (liter) |
| Drying | 70 to 80° C. | 60 sec | | |

(*) This is an amount of the replenisher per $m^2$ of the photographic paper sample being processed.

The processing solutions used above are mentioned below.

| Color Developer: | Tank Solution | Replenisher |
|---|---|---|
| Water | 800 ml | 800 ml |
| Ethylenediamine-N,N,N,N-tetramethylene-phosphonic Acid | 1.5 g | 2.0 g |
| Potassium Bromide | 0.015 g | — |
| Triethanolamine | 8.0 g | 12.0 g |
| Sodium Chloride | 1.4 g | — |
| Potassium Carbonate | 25 g | 25 g |
| N-ethyl-N-(β-methanesulfonamidoethyl)-3-mehtyl-4-aminoaniline Sulfate | 5.0 g | 7.0 g |
| N,N-bis(carboxymethyl)hydrazine | 4.0 g | 5.0 g |
| N,N-di(sulfoethyl)hydroxylamine/1-Na | 4.0 g | 5.0 g |
| Brightening Agent (WHITEX 4B, product by Sumitomo Chemical Co.) | 1.0 g | 2.0 g |
| Water to make | 1000 ml | 1000 ml |
| pH (25° C.) | 10.05 | 10.45 |

Bleach-fixing Solution:
Both the tank solution and the replenisher were same.

| | |
|---|---|
| Water | 400 ml |
| Ammonium Thiosulfate (70%) | 100 ml |
| Sodium Sulfite | 17 9 |
| Ammonium Ethylenediaminetetraacetato/iron(III) | 55 g |
| Disodium Ethylenediaminetetraacetate | 5 g |
| Ammonium Bromide | 40 g |
| Water to make | 1000 ml |
| pH (25° C.) | 6.0 |

Rinsing Solution:
Both the tank solution and the replenisher were same.

An ion-exchanged water (having calcium content and magnesium content of each being 3 ppm or less) was used.

Next, the samples Nos. 001 to 008 each were imagewise exposed with a three-color separation optical wedge and then processed with the previously prepared running system.

The thus processed samples each having a color image were subjected to a fading test, in which they were exposed to light with a xenon tester (having an illuminance of 200,000 lux) for 10 days. For evaluating the tested samples, the yellow stains, in any, in the non-exposed area of each sample was measured and the percentage of the residual yellow density in the area of each sample having an initial density of 2.0 was obtained.

The results obtained are shown in Table C below.

TABLE C

| | | | After 200,000 lux-Xe Exposure for 10 days | | |
|---|---|---|---|---|---|
| Sample No. | Coupler | Color Image Stabilizer | Stains in Non-exposed Area | Percentage of Residual Yellow Density in Area having Initial Density of 2.0 | Remarks |
| 001 | ExY | — | 0.18 | 50% | comparative sample |
| 002 | ExY | comparative compound (a) | 0.25 | 48 | comparative sample |

TABLE C-continued

| Sample No. | Coupler | Color Image Stabilizer | After 200,000 lux-Xe Exposure for 10 days: Stains in Non-exposed Area | Percentage of Residual Yellow Density in Area having Initial Density of 2.0 | Remarks |
|---|---|---|---|---|---|
| 003 | ExY | comparative compound (b) | 0.20 | 58 | comparative sample |
| 004 | ExY | A-1 | 0.18 | 84 | sample of the invention |
| 005 | ExY | A-10 | 0.17 | 82 | sample of the invention |
| 006 | ExY | B-11 | 0.18 | 79 | sample of the invention |
| 007 | ExY | C-1 | 0.17 | 83 | sample of the invention |
| 008 | ExY | C-7 | 0.18 | 82 | sample of the invention |

Comparative compounds (a) and (b) are the same as those in Example 1.

From the results in Table C above, it is clear that the compounds of the present invention have an excellent anti-fading effect in these multi-layer photographic materials.

EXAMPLE 4

A sample was prepared in the same manner as in preparation of sample No. 101 of Example 1 of JP-A-2-854, except that compound (A-1), (A-10), (S-11), (C-1) or (C-7) of the present invention was added to the twelfth layer and the thirteenth layer each in an amount of 25 mol % to the coupler therein by co-emulsification.

Another sample was prepared also in the same manner as in preparation of the sample No. 101 of the same, except that compound (A-1), (A-10), (B-11), (C-1) or (C-7) of the present invention was added to the seventh layer, eighth layer and ninth layer each in an amount of 25 mol % to the coupler therein by co-emulsification.

These samples were exposed and developed in the same manner as in Example 1 of JP-A-2-854, and the processed samples were subjected to the same fading test as above. As a result, the samples of the present invention had an excellent anti-fading effect and had good photographic properties.

From the results, it is clear that the compounds of the present invention had an excellent anti-fading effect in these photographic materials.

EXAMPLE 5

A sample was prepared in the same manner as in preparation of the color photographic material sample of Example 2 of JP-A-1-158431, except that compound (A-1), (A-10), (B-11), (C-1) or (C-7) of the present invention was added to the sixth layer and the seventh layer in place of Cpd-9 therein each in an amount of 25 mol % of the amount of Cpd-9.

Another sample was prepared also in the same manner as in preparation of the color photographic material sample of the Example 2 of the same, except that compound (A-1), (A-10), (B-11), (C-1) or (C-7) of the present invention was added to the eleventh layer and the twelfth layer in place of Cpd-6 therein, each in the same molar amount as Cpd-6.

These samples were exposed and developed in the same manner as in Example 2 of JP-A-1-158431, and the processed samples were subjected to the same fading test as above and the photographic properties of them were examined. As a result, the samples of the present invention had an excellent anti-fading effect and had good photographic properties.

From the results, it is clear that compounds of the present invention had an excellent anti-fading effect in these photographic materials.

As has been verified by the examples mentioned above, fastness of photographic images to light is improved by incorporation of the compounds of formulae (A) to (C) of the present invention to photographic materials.

While the invention has been described in detail and with reference to specific embodiments thereof, it will be apparent to one skilled in the art that various changes, substitutions, and modifications can be made therein without departing from the spirit and scope thereof.

What is claimed is:

1. A silver halide color photographic material comprising a support having provided thereon at least one silver halide emulsion layer, wherein said material comprises at least one layer containing at least one compound which does not undergo a coupling reaction with an oxidation product of a developing agent and which is represented by the following general formula (A) or (C):

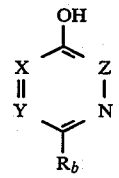

(A)

wherein one of X, Y and Z represents —N=, and the other two each represent —C(Ra)=, or X, Y and Z each represents —C(Ra)=;

the plural Ra's are the same as or different from each other and each represents a hydrogen atom, a halogen atom, an aliphatic group, an aryl group, a heterocyclic group, an acylamino group, a sulfonamide group, a carbamoyl group, a sulfamoyl group, a carbamoylamino group, a sulfamoylamino group, an aliphatic-, aryl-heterocyclic-oxycarbonylamino group, an aliphatic-, aryl- or heterocyclic-oxycarbonyl, an acyl group, a sulfonyl group, or an aliphatic-, aryl- or heterocyclic-oxy group;

Rb is an aliphatic group, an aryl group or a hydroxyl group;

any adjacent Ra's or adjacent Ra and Rb may be bonded to each other to form a 5-membered ring to 7-membered ring; when Ra in Y is bonded to Rb to form a 5-membered ring to 7-membered ring; and the formula may form a dimer or a higher polymer at Ra, Rb or both;

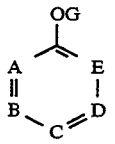

(C)

wherein one or two of A, B, C, D and E represent —N=, and the others each represent —C(Rf)=;

each of the Rf's is the same as or different from one another and represent a hydrogen atom, a halogen atom, an aliphatic group, an aryl group, a heterocyclic group, an acylamino group, a carbamoyl group, a sulfamoyl group, a carbamoylamino group, an aliphatic-, aryl- or heterocyclic-oxycarbonylamino group, an aliphatic-, aryl- or heterocyclic-oxycarbonyl group, an acyl group, a sulfonyl group, an aliphatic-, aryl- or heterocyclic-oxy group, an aliphatic-, aryl- or heterocyclic-thio group, an acyloxy group, a sulfonyloxy group, or an amino group, provided that all Rf's must not be hydrogen atoms at the same time;

G represents an aliphatic group, an aryl group, a heterocyclic group, an acyl group, or a sulfonyl group;

any adjacent Rf's may be bonded to each other to form a 5-membered to 7-membered ring; and the formula may form a dimer or higher polymer at Rf and G or both.

2. The silver halide color photographic material according to claim 1, wherein the compound represents formula (A).

3. The silver halide color photographic material according to claim 1, wherein X, Y and Z each represents —C(Ra)=.

4. The silver halide color photographic material according to claim 1, wherein Ra is a hydrogen atom, an alkyl group, an aryl group, a heterocyclic group, an acylamino group, an alkyl or aryloxycarbonylamino group, a carbamoylamino group, an alkoxycarbonyl group or a carbamoyl group.

5. The silver halide color photographic material according to claim 1, wherein Z is —C(Ra)= and Ra in Z is is not a hydrogen atom.

6. The silver halide color photographic material according to claim 1, wherein at least one of Ra's is an acylamino group, an alkyl or aryloxycarbonylamino group or a carbamoylamino group.

7. The silver halide color photographic material according to claim 1, wherein at least one of Ra's is acylamino group.

8. The silver halide color photographic material according to claim 1, wherein Rb is an alkyl group.

9. The silver halide photographic material according to claim 1, wherein A and B, or A and D, or B and C, or B and D, or only A, or only B are/is —N=, and the others are —C(Rf)=.

10. The silver halide photographic material according to claim 1, wherein B and D, or only B are/is —N=, and the others are —C(Rf)=.

11. The silver halide photographic material according to claim 1, wherein Rf is a hydrogen atom, an alkyl group, an aryl group, a heterocyclic group, an acylamino group, an alkyl or aryloxycarbonylamino group, a carbamoylamino group, an alkoxycarbonyl group, a carbamoyl group, an alkyl or aryloxy group, an alkyl or arylthio group or a halogen atom.

12. The silver halide photographic material according to claim 1, wherein G is an alkyl group, an alkenyl group, a heterocyclic group or an acyl group.

13. The silver halide photographic material according to claim 1, wherein G is an alkyl group.

14. The silver halide color photographic material according to claim 1, wherein the at least one layer is a light-sensitive silver halide emulsion layer containing at least one coupler.

15. The silver halide color photographic material according to claim 1, wherein compound (A) or (C) is present in an amount of from 0.5 to 300 mol % of the coupler(s) present in the emulsion layer.

* * * * *